US010589524B2

(12) United States Patent
Shimizu

(10) Patent No.: US 10,589,524 B2
(45) Date of Patent: Mar. 17, 2020

(54) LIQUID JET HEAD, LIQUID JET RECORDING DEVICE, METHOD FOR DRIVING LIQUID JET HEAD, AND PROGRAM FOR DRIVING LIQUID JET HEAD

(71) Applicant: SII Printek Inc., Chiba-shi, Chiba (JP)

(72) Inventor: Takayuki Shimizu, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/842,203

(22) Filed: Dec. 14, 2017

(65) Prior Publication Data

US 2018/0170042 A1 Jun. 21, 2018

(30) Foreign Application Priority Data

Dec. 16, 2016 (JP) ..... 2016-244236
Sep. 29, 2017 (JP) ..... 2017-190225

(51) Int. Cl.
*B41J 2/045* (2006.01)

(52) U.S. Cl.
CPC ..... *B41J 2/04581* (2013.01); *B41J 2/04541* (2013.01); *B41J 2/04591* (2013.01); *B41J 2/04593* (2013.01)

(58) Field of Classification Search
CPC ..... B41J 2/04581; B41J 2/04541; B41J 2/04591; B41J 2/04593
See application file for complete search history.

(56) References Cited

U.S. PATENT DOCUMENTS 5,736,994 A 4/1998 Takahashi
6,145,949 A 11/2000 Takahashi
6,350,003 B1 2/2002 Ishikawa
6,419,336 B1 7/2002 Takahashi
(Continued)

FOREIGN PATENT DOCUMENTS

JP 2001-301207 A 10/2001
JP 2007-210348 A 8/2007

OTHER PUBLICATIONS

Extended European Search Report in European Application No. 17207118.5, dated Apr. 24, 2018, pp. 1-7.
(Continued)

*Primary Examiner* — Huan H Tran
(74) *Attorney, Agent, or Firm* — Brinks, Gilson & Lione

(57) ABSTRACT

Reduction of the size of the droplet in 1-drop ejection is easily performed. A liquid jet head according to an example of the disclosure includes a nozzle adapted to jet a liquid, a piezoelectric actuator having a pressure chamber communicated with the nozzle and filled with the liquid, and adapted to vary a capacity of the pressure chamber, and a control section adapted to apply a pulse signal to the piezoelectric actuator to thereby expand and contract the capacity of the pressure chamber so as to jet the liquid filling the pressure chamber. The control section applies the pulse signal adapted to expand the capacity in the pressure chamber when jetting 1 drop of the liquid so as to include a first pulse signal having a pulse width one of equal to or shorter than an on-pulse peak, and a second pulse signal disposed with a predetermined time interval from the first pulse signal.

8 Claims, 15 Drawing Sheets

(56) References Cited

U.S. PATENT DOCUMENTS

| | | | | |
|---|---|---|---|---|
| 6,705,696 | B1 * | 3/2004 | Okuda | B41J 2/04541 347/10 |
| 7,950,759 | B2 * | 5/2011 | Kim | B41J 2/04581 347/10 |
| 2001/0024214 | A1 | 9/2001 | Takahashi et al. | |
| 2009/0244139 | A1 | 10/2009 | Takahashi | |
| 2013/0335468 | A1 * | 12/2013 | Kuki | B41J 2/04581 347/10 |
| 2018/0370247 | A1 * | 12/2018 | Kuki | B41J 2/195 |
| 2019/0077146 | A1 * | 3/2019 | Shimazoe | B41J 2/04588 |

OTHER PUBLICATIONS

European Patent Office Communication issued in EP Application No. 17 207 118.5-1019 dated Nov. 27, 2019 (5 pages).

* cited by examiner

| STANDARD DROPLET (SOLVENT INK) | | | |
|---|---|---|---|
| On1 | VOLTAGE ACHIEVING 5 m/s | DROP VOLUME AT VOLTAGE ACHIEVING 5 m/s | COMMENT |
| 0.42AP | 151.2% | 100.0% | |
| 0.54AP | 135.2% | 98.8% | |
| 0.65AP | 117.2% | 95.2% | |
| 0.77AP | 109.4% | 97.6% | |
| 0.88AP | 102.9% | 97.6% | |
| 1.00AP | 100.0% | 100.0% | AP: REFERENCE VALUE |
| 1.23AP | 100.8% | 104.8% | |
| 1.46AP | 112.3% | 113.3% | |
| 1.69AP | 137.7% | 119.3% | |
| 1.92AP | 170.9% | 179.5% | |
| 2.15AP | 186.5% | 234.9% | |
| 2.38AP | 153.7% | 179.5% | |
| 2.62AP | 144.7% | 186.7% | |
| 2.85AP | 130.3% | 167.5% | |
| 3.08AP | 120.9% | 155.4% | |
| 3.31AP | 119.7% | 157.8% | DROPLET BREAKUP |
| 3.54AP | 129.5% | 178.3% | DROPLET BREAKUP |
| 3.77AP | 147.1% | 221.7% | |
| 3.88AP | 154.9% | 244.6% | |

| LARGE DROPLET (WATER-BASED INK) | | | |
|---|---|---|---|
| On1 | VOLTAGE ACHIEVING 5 m/s | DROP VOLUME AT VOLTAGE ACHIEVING 5 m/s | COMMENT |
| 0.37AP | 162.0% | 92.5% | |
| 0.45AP | 146.2% | 97.3% | |
| 0.53AP | 131.2% | 95.9% | |
| 0.68AP | 114.9% | 96.6% | |
| 0.84AP | 106.3% | 93.2% | |
| 1.00AP | 100.0% | 100.0% | AP: REFERENCE VALUE |
| 1.16AP | 106.3% | 103.4% | |
| 1.32AP | 114.9% | 108.8% | |
| 1.47AP | 133.9% | 113.6% | |
| 1.63AP | 170.6% | 142.2% | |
| 1.71AP | | | DROPLET EJECTION FAILURE |
| 1.79AP | | | DROPLET EJECTION FAILURE |

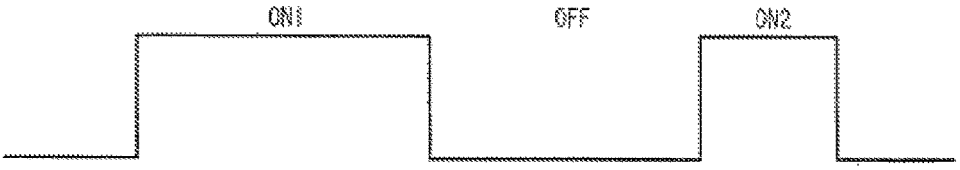

FIG. 11

| STANDARD DROPLET (SOLVENT INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.42AP | 0.85AP | 0.31AP | 148.0% | 49.4% | |
| 0.54AP | 0.85AP | 0.31AP | 125.4% | 57.8% | |
| 0.58AP | 0.85AP | 0.31AP | 122.1% | 61.4% | |
| 0.65AP | 0.85AP | 0.31AP | 111.9% | 66.3% | |
| 0.77AP | 0.85AP | 0.31AP | 103.3% | 74.7% | |
| 1.00AP | 0.85AP | 0.31AP | 96.7% | 88.0% | |
| 1.23AP | 0.85AP | 0.31AP | 105.3% | 104.8% | |
| 1.46AP | 0.85AP | 0.31AP | 111.9% | 109.6% | |
| 1.69AP | 0.85AP | 0.31AP | 137.7% | 125.3% | |
| 1.92AP | 0.85AP | 0.31AP | UNMEASURABLE | | DROPLET EJECTION FAILURE |
| 2.15AP | 0.85AP | 0.31AP | UNMEASURABLE | | DROPLET EJECTION FAILURE |
| 2.38AP | 0.85AP | 0.31AP | 152.5% | 171.1% | |
| 2.50AP | 0.85AP | 0.31AP | 146.7% | 167.5% | |
| 2.62AP | 0.85AP | 0.31AP | 146.7% | 178.3% | |
| 2.85AP | 0.85AP | 0.31AP | 128.7% | 154.2% | |
| 3.08AP | 0.85AP | 0.31AP | 118.9% | 147.0% | |
| 3.31AP | 0.85AP | 0.31AP | 117.6% | 151.8% | |
| 3.54AP | 0.85AP | 0.31AP | 126.2% | 171.1% | |
| 3.77AP | 0.85AP | 0.31AP | 144.3% | 219.3% | |
| 3.88AP | 0.85AP | 0.31AP | 152.0% | 242.2% | |

FIG. 12

| LARGE DROPLET (WATER-BASED INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.29AP | 0.82AP | 0.29AP | | | DROPLET EJECTION FAILURE |
| 0.37AP | 0.82AP | 0.29AP | 158.4% | 49.0% | |
| 0.53AP | 0.82AP | 0.29AP | 128.5% | 68.0% | |
| 0.68AP | 0.82AP | 0.29AP | 111.3% | 78.9% | |
| 0.84AP | 0.82AP | 0.29AP | 103.6% | 86.4% | |
| 1.00AP | 0.82AP | 0.29AP | 102.3% | 93.9% | |
| 1.16AP | 0.82AP | 0.29AP | 105.9% | 100.7% | |
| 1.32AP | 0.82AP | 0.29AP | 114.9% | 104.1% | |
| 1.47AP | 0.82AP | 0.29AP | 134.8% | 120.4% | |
| 1.63AP | 0.82AP | 0.29AP | 171.5% | | DROPLET EJECTION FAILURE |
| 1.71AP | 0.82AP | 0.29AP | | | DROPLET EJECTION FAILURE |
| 1.79AP | 0.82AP | 0.29AP | | | DROPLET EJECTION FAILURE |

| STANDARD DROPLET (SOLVENT INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.65AP | 0.42AP | 0.31AP | | | DROPLET EJECTION FAILURE |
| 0.65AP | 0.65AP | 0.31AP | 124.2% | 51.8% | DROPLET BREAKUP |
| 0.65AP | 0.77AP | 0.31AP | 117.6% | 62.7% | DROPLET BREAKUP |
| 0.65AP | 0.88AP | 0.31AP | 114.3% | 71.1% | |
| 0.65AP | 1.00AP | 0.31AP | 113.5% | 81.9% | |
| 0.65AP | 1.12AP | 0.31AP | 117.6% | 90.4% | |
| 0.65AP | 1.35AP | 0.31AP | 120.9% | 100.0% | DROPLET BREAKUP |
| 0.65AP | 1.58AP | 0.31AP | 116.8% | 136.1% | DROPLET BREAKUP |
| 0.65AP | 1.81AP | 0.31AP | 127.0% | 180.7% | DROPLET BREAKUP |
| 0.65AP | 2.04AP | 0.31AP | 131.1% | 177.1% | DROPLET BREAKUP |
| 0.65AP | 2.27AP | 0.31AP | 118.4% | 118.1% | DROPLET BREAKUP |
| 0.65AP | 2.50AP | 0.31AP | 118.0% | 96.4% | DROPLET BREAKUP |
| 0.65AP | 2.73AP | 0.31AP | 120.1% | 100.0% | DROPLET BREAKUP |
| 0.65AP | 2.96AP | 0.31AP | 118.0% | 97.6% | DROPLET BREAKUP |
| 0.65AP | 3.19AP | 0.31AP | 120.9% | 101.2% | DROPLET BREAKUP |
| 0.65AP | 3.42AP | 0.31AP | 118.4% | 96.4% | DROPLET BREAKUP |
| 0.65AP | 3.65AP | 0.31AP | 117.6% | | DROPLET EJECTION FAILURE |

FIG. 15

| LARGE DROPLET (WATER-BASED INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.53AP | 0.45AP | 0.29AP | | | DROPLET EJECTION FAILURE |
| 0.53AP | 0.61AP | 0.29AP | 151.1% | 46.9% | |
| 0.53AP | 0.68AP | 0.29AP | 142.5% | 52.4% | |
| 0.53AP | 0.76AP | 0.29AP | 133.0% | 60.5% | |
| 0.53AP | 0.92AP | 0.29AP | 128.5% | 76.2% | |
| 0.53AP | 1.08AP | 0.29AP | 131.7% | 87.1% | |
| 0.53AP | 1.24AP | 0.29AP | 133.0% | | DROPLET BREAKUP |
| 0.53AP | 1.39AP | 0.29AP | 149.3% | | DROPLET BREAKUP |
| 0.53AP | 1.55AP | 0.29AP | 140.3% | | DROPLET BREAKUP |
| 0.53AP | 1.71AP | 0.29AP | | | DROPLET BREAKUP |

| STANDARD DROPLET (SOLVENT INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.65AP | 0.88AP | 0.12AP | 116.8% | 79.5% | |
| 0.65AP | 0.88AP | 0.19AP | 121.3% | 77.1% | |
| 0.65AP | 0.88AP | 0.27AP | 113.1% | 72.3% | |
| 0.65AP | 0.88AP | 0.35AP | 114.3% | 72.3% | |
| 0.65AP | 0.88AP | 0.42AP | 113.5% | 69.9% | |
| 0.65AP | 0.88AP | 0.50AP | 113.1% | 68.7% | |
| 0.65AP | 0.88AP | 0.58AP | 113.1% | 73.5% | |
| 0.65AP | 0.88AP | 0.65AP | 114.3% | 148.2% | DROPLET BREAKUP |
| 0.65AP | 0.88AP | 0.73AP | 124.2% | 194.0% | DROPLET BREAKUP |
| 0.65AP | 0.88AP | 0.81AP | 117.6% | 172.3% | DROPLET BREAKUP |
| 0.65AP | 0.88AP | 0.96AP | 106.6% | 175.9% | DROPLET BREAKUP |
| 0.65AP | 0.88AP | 1.12AP | 98.8% | 168.7% | |
| 0.65AP | 0.88AP | 1.27AP | 95.1% | 167.5% | |
| 0.65AP | 0.88AP | 1.42AP | 94.3% | 168.7% | |
| 0.65AP | 0.88AP | 1.58AP | 98.0% | 172.3% | |
| 0.65AP | 0.88AP | 1.73AP | 104.9% | 178.3% | DROPLET BREAKUP |
| 0.65AP | 0.88AP | 1.88AP | 119.3% | 196.4% | DROPLET BREAKUP |
| 0.65AP | 0.88AP | 2.04AP | 114.3% | 172.3% | DROPLET BREAKUP |
| 0.65AP | 0.88AP | 2.19AP | 113.9% | 120.5% | DROPLET BREAKUP |
| 0.65AP | 0.88AP | 2.35AP | 115.2% | 96.4% | DROPLET BREAKUP |

FIG. 18

| LARGE DROPLET (WATER-BASED INK) | | | | | |
|---|---|---|---|---|---|
| On1 | OFF | On2 | VOLTAGE ACHIEVING 5 m/s | DROP VOLUME AT VOLTAGE ACHIEVING 5 m/s | COMMENT |
| 0.53AP | 0.76AP | 0.13AP | 136.2% | 70.1% | |
| 0.53AP | 0.76AP | 0.24AP | 133.9% | 61.2% | |
| 0.53AP | 0.76AP | 0.34AP | 132.6% | 59.2% | |
| 0.53AP | 0.76AP | 0.45AP | 132.6% | 57.1% | |
| 0.53AP | 0.76AP | 0.55AP | 133.0% | 145.6% | |
| 0.53AP | 0.76AP | 0.66AP | 133.9% | 174.8% | DROPLET BREAKUP |
| 0.53AP | 0.76AP | 0.76AP | 123.1% | 172.1% | DROPLET BREAKUP |
| 0.53AP | 0.76AP | 0.87AP | 114.9% | 169.4% | DROPLET BREAKUP |
| 0.53AP | 0.76AP | 0.97AP | 109.0% | 168.0% | DROPLET BREAKUP |
| 0.53AP | 0.76AP | 1.08AP | 104.5% | 165.3% | DROPLET BREAKUP |
| 0.53AP | 0.76AP | 1.18AP | 101.8% | 164.6% | DROPLET BREAKUP |
| 0.53AP | 0.76AP | 1.29AP | 100.9% | 165.3% | DROPLET BREAKUP |
| 0.53AP | 0.76AP | 1.39AP | 102.7% | 167.3% | DROPLET BREAKUP |

FIG. 19

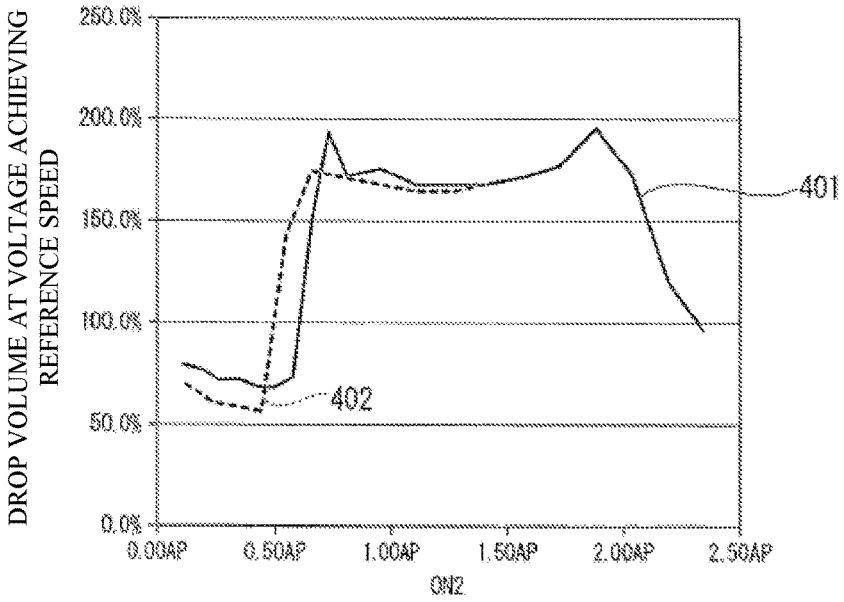

FIG. 20

| LARGE DROPLET (WATER-BASED INK) | | | | | | |
|---|---|---|---|---|---|---|
| On11 | OFF1 | On12 | OFF2 | On2 | VOLTAGE ACHIEVING 6 m/s | DROP VOLUME AT VOLTAGE ACHIEVING 6m/s |
| 0.58AP | 1.42AP | 0.54AP | 0.46AP | 0.31AP | 139.0% | 107.2% |
| 0.58AP | 1.42AP | 0.62AP | 0.46AP | 0.31AP | 123.9% | 94.1% |
| 0.58AP | 1.42AP | 0.69AP | 0.46AP | 0.31AP | 119.3% | 90.8% |
| 0.58AP | 1.42AP | 0.77AP | 0.46AP | 0.31AP | 114.7% | 88.9% |
| 0.58AP | 1.42AP | 0.85AP | 0.46AP | 0.31AP | 110.6% | 88.9% |
| 0.58AP | 1.42AP | 0.92AP | 0.46AP | 0.31AP | 108.3% | 88.2% |
| 0.58AP | 1.42AP | 1.00AP | 0.46AP | 0.31AP | 106.4% | 88.9% |
| 0.58AP | 1.42AP | 1.08AP | 0.46AP | 0.31AP | 107.3% | 87 6% |
| 0.58AP | 1.42AP | 1.15AP | 0.46AP | 0.31AP | 108.7% | 89.5% |
| 0.58AP | 1.42AP | 1.23AP | 0.46AP | 0.31AP | 111.5% | 91 5% |
| 0.58AP | 1.42AP | 1.31AP | 0.46AP | 0.31AP | 116.1% | 95.4% |
| 0.58AP | 1.42AP | 1.38AP | 0.46AP | 0.31AP | 122.0% | 98.7% |

LIQUID JET HEAD, LIQUID JET RECORDING DEVICE, METHOD FOR DRIVING LIQUID JET HEAD, AND PROGRAM FOR DRIVING LIQUID JET HEAD

RELATED APPLICATIONS

This application claims priority under 35 U.S.C. § 119 to Japanese Patent Applications No. 2016-244236 filed on Dec. 16, 2016 and No. 2017-190225 filed on Sep. 29, 2017, the entire content of which are hereby incorporated by reference.

BACKGROUND OF THE INVENTION

Field of the Invention

The present disclosure is related to a liquid jet head, a liquid jet recording device, a method for driving the liquid jet head, and a program for driving the liquid jet head.

Background Art

A liquid jet recording device equipped with a liquid jet head is used in a variety of fields. In the liquid jet head, due to application of a pulse signal to a piezoelectric actuator, the capacity of a pressure chamber varies, and thus, a liquid filling the pressure chamber is jetted from a nozzle. When ejecting a drop of the liquid from the nozzle, there is used the pulse signal defining the pulse width of an on-pulse peak (AP), with which the ejection speed becomes the maximum, as 1 pulse, and the drop volume corresponding to this pulse width becomes the minimum.

For example, in JP-A-2007-210348, there is described a technology of applying the pulse signal with 1 pulse continuously a plurality of times to eject a plurality of droplets from the nozzle to thereby grow the droplet in size, and thus forming grayscale or high-concentration pixels.

In such a liquid jet head, in general, it is required to make the image quality high-definition. It is desirable to provide a liquid jet head, a liquid jet recording device, a method for driving the liquid jet head, and a program for driving the liquid jet head each capable of making the image quality high-definition.

SUMMARY OF THE INVENTION

A liquid jet head according to an example of the disclosure includes a nozzle adapted to jet a liquid, a piezoelectric actuator having a pressure chamber communicated with the nozzle and filled with the liquid, and adapted to vary a capacity of the pressure chamber, and a control section adapted to apply a pulse signal to the piezoelectric actuator to thereby expand and contract the capacity of the pressure chamber so as to jet the liquid filling the pressure chamber. The control section applies the pulse signal adapted to expand the capacity in the pressure chamber when jetting 1 drop of the liquid so as to include a first pulse signal having a pulse width one of equal to or shorter than an on-pulse peak, and a second pulse signal disposed with a predetermined time interval from the first pulse signal. It should be noted that "jetting 1 drop" mentioned here denotes the state in which 1 drop of the liquid is finally jetted from the nozzle to the outside independently of the number of pulse signals described above to be applied by the control section, and the same applies to the following.

A liquid jet recording device according to an embodiment of the disclosure is equipped with the liquid jet head according to an embodiment of the disclosure.

A method for driving a liquid jet head according to an embodiment of the disclosure includes the step of applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet 1 drop of liquid filling the pressure chamber from the nozzle, wherein applying the pulse signal includes applying a first pulse signal having a pulse width one of equal to or shorter than a width of an on-pulse peak, and applying a second pulse signal disposed with a predetermined time interval from the first pulse signal.

A program for driving a liquid jet head and adapted to make a computer perform a process includes the step of applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet a drop of liquid filling the pressure chamber from the nozzle, applying the pulse signal includes applying a first pulse signal having a pulse width one of equal to or shorter than a width of an on-pulse peak, and applying a second pulse signal disposed with a predetermined time interval from the first pulse signal.

According to the liquid jet head, the liquid jet recording device, the method for driving the liquid jet head, and the program for driving the liquid jet head, it becomes possible to make the image quality high-definition.

BRIEF DESCRIPTION OF THE DRAWINGS

FIG. 11 is a diagram showing an example of the drive waveform in the first embodiment of the disclosure.

FIG. 12 is a table showing a first example of an experimental result when varying the width of "ON1" of a main pulse signal in the first embodiment of the disclosure.

FIG. 15 is a table showing a first example of an experimental result when varying the width of "OFF" in a second embodiment of the disclosure.

FIG. 18 is a table showing a first example of an experimental result when varying the width of "ON2" in a third embodiment of the disclosure.

FIG. 19 is a table showing a second example of the experimental result when varying the width of "ON2" in the third embodiment of the disclosure.

FIG. 20 is a diagram obtained by graphing the experimental result shown in FIG. 18 and FIG. 19.

DETAILED DESCRIPTION OF THE INVENTION

Some embodiments of the disclosure will hereinafter be described in detail with reference to the drawings. It should be noted that the description will be presented in the following order.

1. First Embodiment (an example of the case of varying the width of "ON1" as a first pulse signal)
2. Second Embodiment (an example of the case of varying the width of "OFF" as a predetermined time interval)
3. Third Embodiment (an example of the case of varying the width of "ON2" as a second pulse signal)
4. Fourth Embodiment (an example of the case of providing a plurality of pulse signals prior to the second pulse signal)
5. Modified Examples <1. First Embodiment>

Firstly, the first embodiment will be described.

(Liquid Jet Recording Device)

A schematic configuration of a liquid jet recording device 1 according to the first embodiment will be described. It should be noted that the method for driving a liquid jet head according to the first embodiment is embodied in the liquid jet recording device 1 according to the first embodiment, and will therefore be described at the same time.

Figure 1:
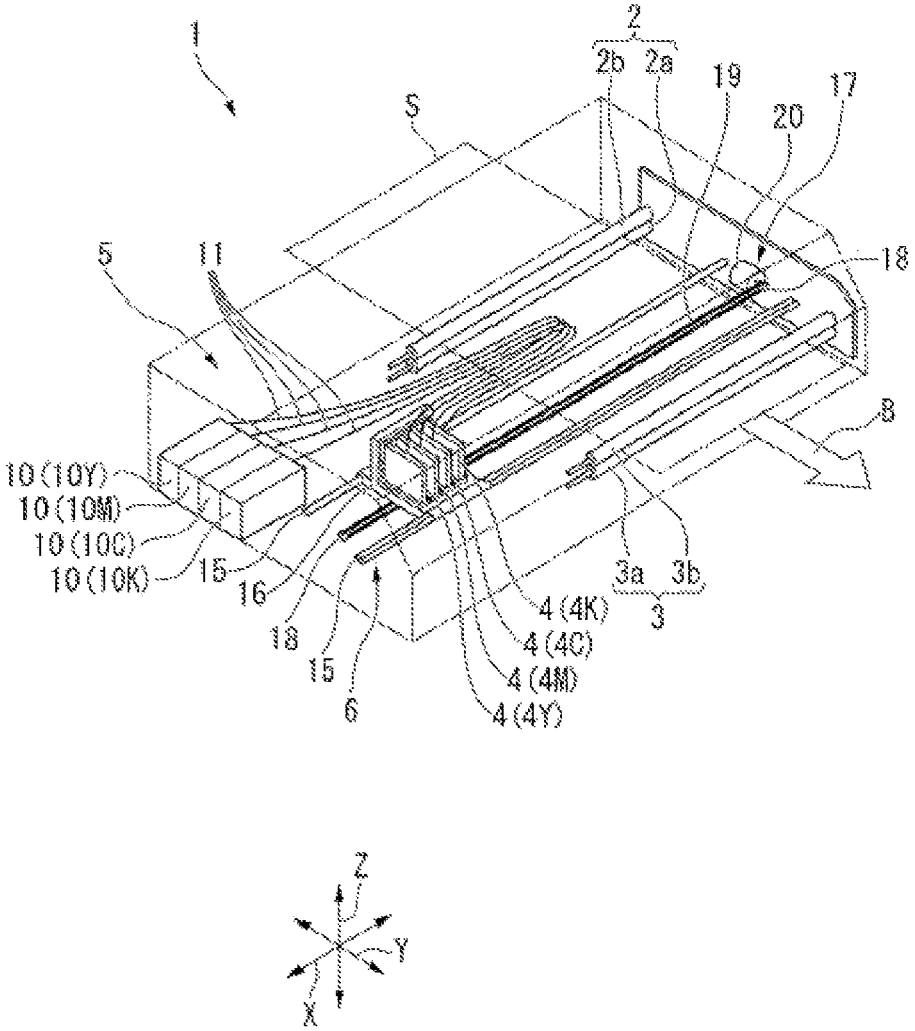
FIG. 1 is a perspective view showing a configuration of a liquid jet recording device according to a first embodiment of the disclosure.

FIG. 1 is a perspective view showing a configuration of the liquid jet recording device 1. It should be noted that in the following drawings, the scale size of each member is arbitrarily altered so as to make the description easy to understand.

As shown in FIG. 1, the liquid jet recording device 1 is provided with a pair of conveyers 2, 3 for conveying a recording target medium S such as recording paper, liquid jet heads 4 for ejecting ink not shown to the recording target medium S, an ink supply unit 5 for supplying the liquid jet heads 4 with the ink, and a scanner 6 for making the liquid jet heads 4 perform a scanning operation in a scanning direction X perpendicular to the conveying direction Y of the recording target medium S.

It should be noted that in the first embodiment, the direction perpendicular to the two directions, namely the conveying direction Y and the scanning direction X, is defined as a vertical direction Z. Further, the ink described above corresponds to a specific example of the "liquid" in the disclosure.

The pair of conveyers 2, 3 are disposed with a distance in the conveying direction Y, and specifically, the conveyer 2, one of the pair of conveyers, is located on the upstream side in the conveying direction Y, and the conveyer 3, the other of the pair of conveyers, is located on the downstream side in the conveying direction Y. These conveyers 2, 3 are provided with grit rollers 2*a*, 3*a* each extending in the scanning direction X, pinch rollers 2*b*, 3*b* arranged in parallel to the grit rollers 2*a*, 3*a* and for pinching the recording target medium S with the grit rollers 2*a*, 3*a*, and a drive mechanism not shown such as a motor for rotating the grit rollers 2*a*, 3*a* around the respective axes. Further, by rotating the grit rollers 2*a*, 3*a* of the pair of conveyers 2, 3, it is possible to convey the recording target medium S in the direction of the arrow B along the conveying direction Y.

The ink supply unit 5 is provided with ink tanks 10 each housing the ink, and ink pipes 11 for respectively connecting the ink tanks 10 and the liquid jet heads 4 to each other.

In the example shown in the drawing, as the ink tanks 10, the ink tanks 10Y, 10M, 10C, and 10K respectively housing the ink of four colors of yellow (Y), magenta (M), cyan (C), and black (K) are arranged along the conveying direction Y. The ink pipes 11 are each, for example, a flexible hose having flexibility, and are made capable of following the action (movement) of a carriage 16 for supporting the liquid jet heads 4.

The scanner 6 is provided with a pair of guide rails 15, the carriage 16, and a drive mechanism 17, wherein the pair of guide rails 15 extend in the scanning direction X, and are disposed in parallel to each other with a distance in the conveying direction Y, the carriage 16 is disposed so as to be movable along the pair of guide rails 15, and the drive mechanism 17 moves the carriage 16 in the scanning direction X.

The drive mechanism 17 is provided with a pair of pulleys 18, an endless belt 19, and a drive motor 20, wherein the pair of pulleys 18 are disposed between the pair of guide rails 15 with a distance in the scanning direction X, the endless belt 19 is wound between the pair of pulleys 18, and moves in the scanning direction X, and the drive motor 20 rotationally drives one of the pulleys 18.

The carriage 16 is connected to the endless belt 19, and is made movable in the scanning direction X in accordance with the movement of the endless belt 19 due to the rotational drive of the one of the pulleys 18. Further, on the carriage 16, there is mounted the plurality of liquid jet heads 4 in the state of being arranged in the scanning direction X.

In the example shown in the drawing, there are mounted the four liquid jet heads 4, namely the liquid jet heads 4Y, 4M, 4C, and 4K, for respectively ejecting the ink of four colors of yellow (Y), magenta (M), cyan (C), and black (K).

(Liquid Jet Head)

Then, the liquid jet heads 4 will be described in detail.

Figure 2:
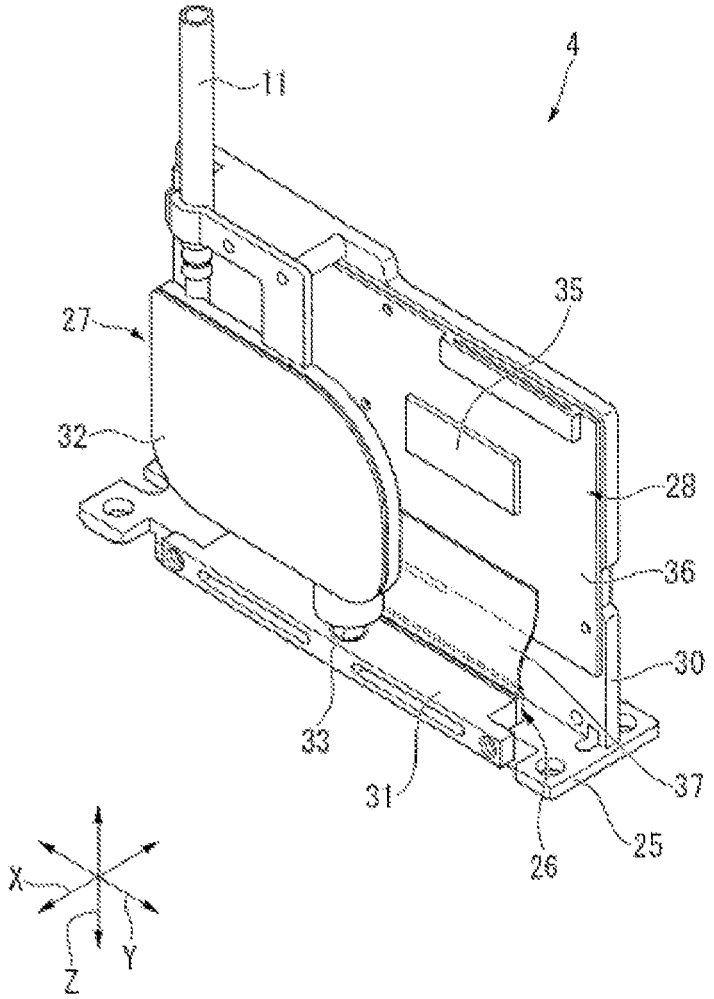
FIG. 2 is a perspective view of a liquid jet head according to the first embodiment of the disclosure.

FIG. 2 is a perspective view of the liquid jet head 4. As shown in FIG. 2, the liquid jet head 4 is provided with a fixation plate 25, a head chip 26, an ink supply section 27, and a control section 28, wherein the fixation plate 25 is fixed to the carriage 16, the head chip 26 is fixed on the fixation plate 25, the ink supply section 27 further supplies an ink introduction hole 41*a* described later of the head chip 26 with the ink having been supplied from the ink supply unit 5, and the control section 28 applies a drive voltage to the head chip 26.

The liquid jet heads 4 eject the ink of the respective colors with predetermined jet amounts in response to the application of the drive voltages. On this occasion, by the scanner 6 moving the liquid jet heads 4 in the scanning direction X, it is possible to perform recording in a predetermined range on the recording target medium S. By repeatedly performing the scanning operation while conveying the recording target medium S in the conveying direction Y using the conveyers 2, 3, it becomes possible to perform recording in the entire area of the recording target medium S.

To the fixation plate 25, there are fixed a base plate 30 made of metal such as aluminum in a state of standing along the vertical direction Z, and a flow channel member 31 for supplying the ink to the ink introduction hole 41*a* described later of the head chip 26. Above the flow channel member 31, there is disposed a pressure damper 32 having a reservoir chamber for reserving the ink inside in a state of being supported by the base plate 30. Further, the flow channel member 31 and the pressure damper 32 are connected to each other via an ink connection pipe 33, and to the pressure damper 32, there is connected the ink pipe 11.

In such a configuration, when the ink is supplied via the ink pipe 11, the pressure damper 32 once reserves the ink in the reservoir chamber located inside the pressure damper 32, and then supplies a predetermined amount of the ink to the ink introduction hole 41*a* via the ink connection pipe 33 and the flow channel member 31.

It should be noted that the flow channel member 31, the pressure damper 32, and the ink connection pipe 33 function as the ink supply section 27 described above.

Further, to the fixation plate 25, there is attached an IC board 36 on which a control circuit 35 such as an integrated circuit for driving the head chip 26 is mounted. The control circuit 35, and a common electrode (a drive electrode) and individual electrodes described later (both not shown) of the head chip 26 are electrically connected via a flexible board 37 having a wiring pattern not shown printed as wiring. Thus, it becomes possible for the control circuit 35 to apply the drive voltage between the common electrode and each of the individual electrodes via the flexible board 37.

It should be noted that the IC board 36, on which the control circuit 35 is mounted, and the flexible board 37 function as the control section 28 described above.

(Head Chip)

Next, the head chip 26 will be described in detail.

Figure 3:
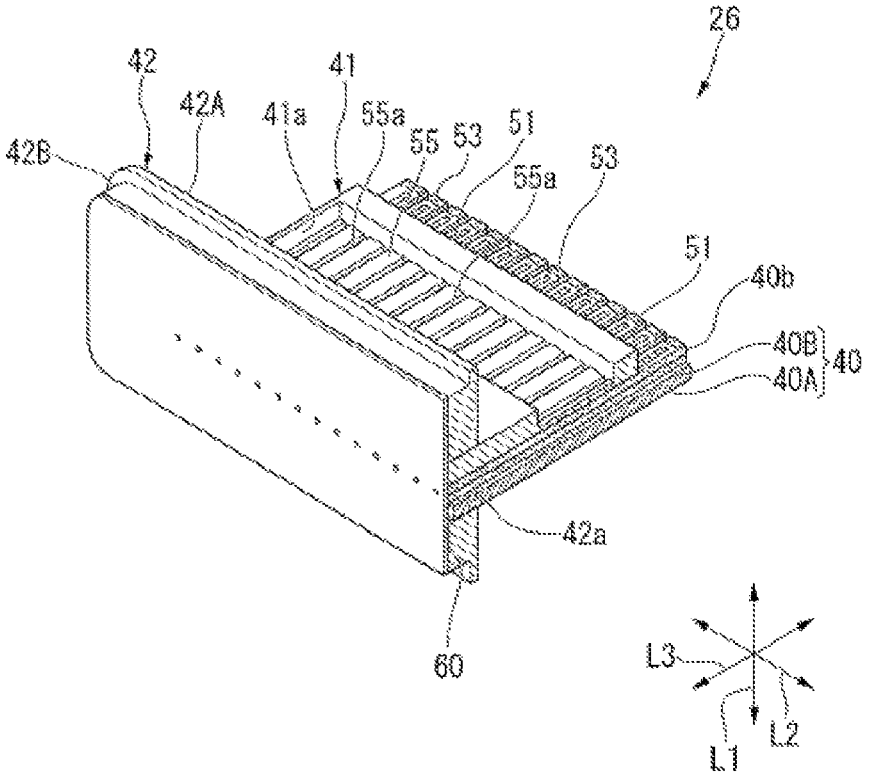
FIG. 3 is a perspective view of a head chip in the first embodiment of the disclosure.
Figure 4:
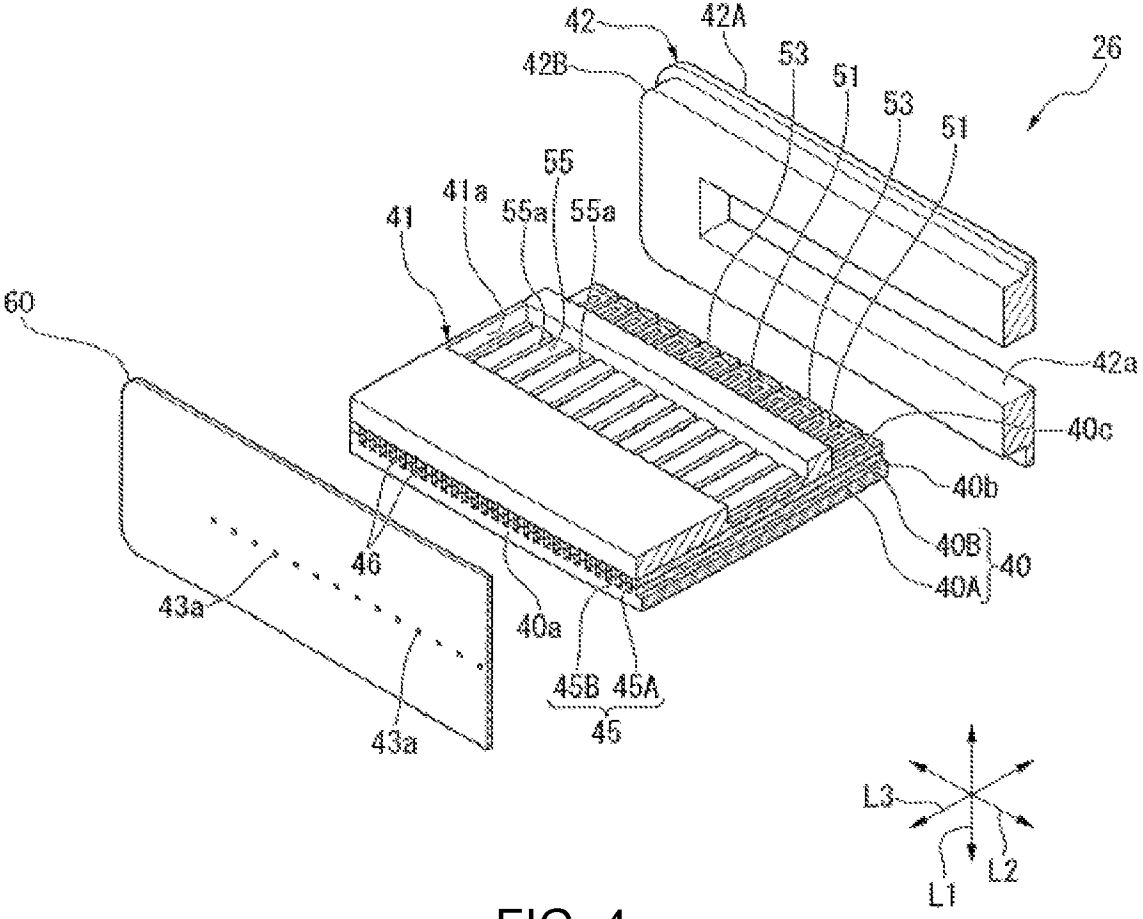
FIG. 4 is an exploded perspective view of the head chip in the first embodiment of the disclosure.

FIG. 3 is a perspective view of the head chip 26, and FIG. 4 is an exploded perspective view of the head chip 26. As shown in FIG. 3 and FIG. 4, the head chip 26 is provided with an actuator plate 40, a cover plate 41, a support plate 42, and a nozzle plate 60, wherein the nozzle plate 60 is disposed on a side surface of the actuator plate 40.

The head chip 26 is made as a so-called edge-shoot type for ejecting the ink from a nozzle hole 43*a* opening at the end part in the longitudinal direction of a liquid ejection channel 45A described later.

The actuator plate 40 is made as a so-called laminated plate having two plates, namely a first actuator plate 40A and a second actuator plate 40B, stacked on one another. It should be noted that the actuator plate 40 can also be formed of a single plate besides the laminated plate. Further, the actuator plate 40 corresponds to a specific example of a "piezoelectric actuator" in the disclosure.

The first actuator plate 40A and the second actuator plate 40B are each a piezoelectric substrate such as a PZT (lead zirconate titanate) ceramics substrate on which a polarization treatment has been performed in the thickness direction, and are bonded to each other in the state in which the respective polarization directions are opposite to each other. The actuator plate 40 is formed to have a roughly rectangular planar shape longer in a first direction (an arrangement direction) L2 perpendicular to the thickness direction L1 and shorter in a second direction L3 perpendicular to the thickness direction L1 and the first direction L2.

It should be noted that since the head chip 26 of the first embodiment is of the edge-shoot type, the thickness direction L1 coincides with the scanning direction X in the liquid jet recording device 1, and at the same time, the first direction L2 coincides with the conveying direction Y, and the second direction L3 coincides with the vertical direction Z. Specifically, out of the side surfaces of the actuator plate 40, for example, the side surface (the side surface located on the side from which the ink is ejected) opposed to the nozzle plate 60 becomes a lower end surface 40*a*, and the side surface located on the opposite side in the second direction L3 to the lower end surface 40*a* becomes an upper end surface 40*b*. In the following description, the description is presented with the simple references of "lower side" and "upper side" in some cases based on the upper and lower directions described here. However, normally, it goes without saying that the upper and lower directions vary in accordance with the installation angle of the liquid jet recording device 1.

On one principal surface (a surface overlapped by the cover plate 41) 40*c* of the actuator plate 40, there is formed a plurality of channels 45 arranged in the first direction L2 at predetermined intervals. These channels 45 are each a groove linearly extending along the second direction L3 in the state of opening on one principal surface 40*c* side, and one side in the longitudinal direction of each of the channels 45 opens on the lower end surface 40*a* side of the actuator plate 40. Between these channels 45, there are formed drive walls (piezoelectric division walls) 46 each having a roughly rectangular cross-sectional shape and extending in the second direction L3. The channels 45 are partitioned by the drive walls 46.

Further, the plurality of channels 45 is roughly divided into liquid ejection channels 45A filled with the ink, and non-ejection channels 45B not filled with the ink. Further, the liquid ejection channels 45A and the non-ejection channels 45B are arranged alternately in the first direction L2. It should be noted that the liquid ejection channel 45A corresponds to a specific example of the "pressure chamber" in the disclosure.

Among these channels, the liquid ejection channels 45A are each formed in the state of opening only on the lower end surface 40*a* side of the actuator plate 40 without opening on the upper end surface 40*b* side. In contrast, the non-ejection channels 45B are each formed so as to open not only on the lower end surface 40*a* side of the actuator plate 40, but also on the upper end surface 40*b* side.

On inner wall surfaces, namely a pair of sidewall surfaces opposed to each other in the first direction L2, and the bottom wall surface, of each of the liquid ejection channels 45A, there is formed the common electrode not shown. The common electrode extends in the second direction L3 along the liquid ejection channel 45A, and is electrically connected to a common terminal 51 formed on the one principal surface 40*c* of the actuator plate 40.

In contrast, among inner wall surfaces of the non-ejection channels 45B, on a pair of sidewall surfaces opposed to each other in the first direction L2, there are respectively formed the individual electrodes not shown. These individual electrodes extend in the second direction L3 along the non-ejection channel 45B, and are electrically connected respectively to individual terminals 53 formed on the one principal surface 40*c* of the actuator plate 40.

It should be noted that the individual terminals 53 are formed on the upper end surface 40*b* side of the common terminal 51 on the one principal surface 40*c* of the actuator plate 40. Further, the individual electrodes (the individual electrodes respectively formed in the non-ejection channels 45B different from each other) respectively located on both sides across the liquid ejection channel 45A are formed so as to be connected to each other.

In such a configuration, when the control circuit 35 applies the drive voltage between the common electrode and the individual electrode via the flexible board 37 and further through the common terminal 51 and the individual terminal 53, the drive walls 46 are deformed. Then, a pressure variation occurs in the ink which fills in the liquid ejection channel 45A. Thus, it is possible to eject the ink in the liquid ejection channel 45A from the nozzle hole 43*a,* and it becomes possible to record a variety of types of information such as characters or figures on the recording target medium S.

On the one principal surface 40*c* of the actuator plate 40, there is overlapped the cover plate 41. In the cover plate 41, there is formed the ink introduction hole 41*a* having a roughly rectangular planar shape elongated in the first direction L2.

In the ink introduction hole 41*a,* there is formed an ink introduction plate 55 provided with a plurality of slits 55*a* for introducing the ink, which has been supplied via the flow channel member 31, into the liquid ejection channels 45A, and at the same time restricting the introduction of the ink into the non-ejection channels 45B. Specifically, the slits 55*a* are formed at positions corresponding respectively to the liquid ejection channels 45A, and it becomes possible to fill only the liquid ejection channels 45A with the ink.

It should be noted that the cover plate 41 is formed of, for example, a PZT ceramics substrate, which is the same material as that of the actuator plate 40, to thereby achieve the same thermal expansion as that of the actuator plate 40, and thus the warpage and the deformation due to the change in temperature are prevented. It should be noted that the invention is not limited to this case, but it is also possible to form the cover plate 41 with a material different from that of the actuator plate 40. In this case, it is preferable to use a material close in thermal expansion coefficient to the actuator plate 40 as the material of the cover plate 41.

The support plate 42 supports the actuator plate 40 and the cover plate 41 overlapped with each other, and at the same time supports the nozzle plate 60. The support plate 42 is a plate member having a roughly rectangular shape elongated in the first direction L2 so as to correspond to the actuator plate 40, and is provided with a fitting hole 42*a* penetrating in the thickness direction formed in most of the central portion. The fitting hole 42*a* is formed along the first direction L2 so as to have a roughly rectangular shape, and supports the actuator plate 40 and the cover plate 41 overlapped with each other in the state of fitting in the fitting hole 42*a.*

Further, the support plate 42 is formed to have a stepped plate shape so that the outer shape of the support plate 42 decreases toward the lower end in the thickness direction due to the step. In other words, the support plate 42 is obtained by integrally molding a base part 42A and a step part 42B with each other, wherein the base part 42A is located on the upper end side in the thickness direction, and the step part 42B is disposed on the lower end surface of the base part 42A and is formed to have a smaller outer shape than that of the base part 42A. Further, the support plate 42 is combined so that the end surface of the step part 42B is coplanar with the lower end surface 40*a* of the actuator plate 40. Further, to the end surface of the step part 42B, there is fixed the nozzle plate 60 with, for example, an adhesive.

(Control Section)

Next, the control section 28 will be described in detail.

Figure 5:
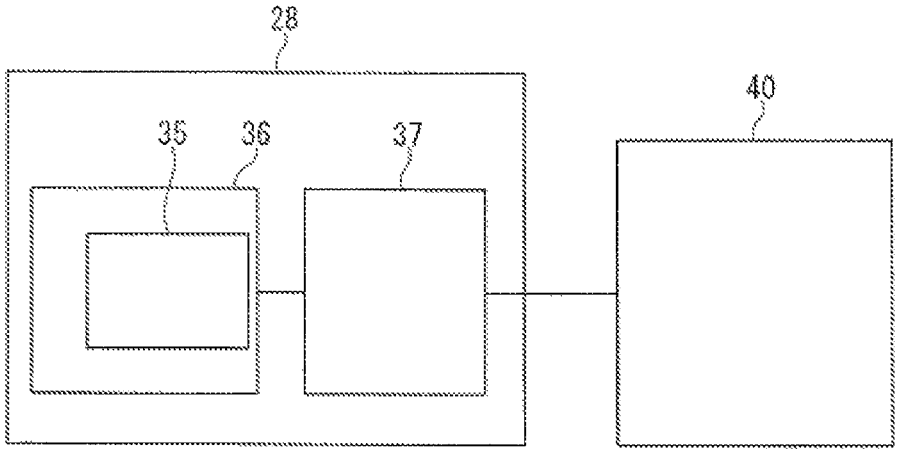
FIG. 5 is a schematic block diagram showing an example of a control section in the first embodiment of the disclosure.

FIG. 5 is a schematic block diagram showing an example of the control section 28. As shown in FIG. 5, in the control section 28, the control circuit 35 mounted on the IC board 36 is electrically connected to the common electrode and the individual electrodes respectively via the flexible board 37, and further through the common terminal 51 and the individual terminals 53 of the actuator plate 40.

The control circuit 35 applies a drive voltage (a pulse signal) between the common electrode and each of the individual electrodes of the actuator plate 40. Thus, the drive walls 46 deform to expand and contract the capacity in the liquid ejection channel 45A (the pressure chamber), and the ink (the liquid) which fills the liquid ejection channel 45A is jetted from the nozzle hole 43*a.*

Specifically, by the control circuit 35 applying, for example, a pulse signal with the positive drive voltage between the common electrode and the individual electrode, the capacity in the liquid ejection channel 45A expands in the period in which the pulse signal is in the high level, and then the capacity in the liquid ejection channel 45A, which has once expanded, contracts to be restored when the high period of the pulse signal ends (a low period begins), and thus, the pressure of the ink filling the liquid ejection channel 45A rises to eject (jet) the ink from the nozzle hole 43*a.*

Further, in the case of ejecting the ink as much as normal 1-drop (making 1-drop ejection), the control circuit 35 sets, for example, the pulse width (the width of the high period) of the pulse signal to the width (the pulse width) of the on-pulse peak so as to maximize the ejection speed. The on-pulse peak (hereinafter referred to as AP) is the concept in which a half of the natural vibration period of the ink in the liquid ejection channel 45A is defined as 1 AP with respect to the liquid jet head 4 having the liquid ejection channel 45A for containing the ink, the nozzle hole 43*a* communicated with the liquid ejection channel 45A and for jetting the ink in the liquid ejection channel 45A, and the actuator plate 40 for expanding or contracting the capacity of the liquid ejection channel 45A.

Further, by setting the pulse width of the pulse signal described above to be equal to or shorter than the width of 1 AP and adding an auxiliary pulse signal after the pulse signal, it is possible for the control circuit 35 to reduce the size of the droplet in the 1-drip ejection. In other words, in the liquid jet head 4 according to the first embodiment, it is possible to control the droplet amount (the drop volume) to be ejected in the 1-drop ejection to a small value without changing the head structure.

Figure 6:
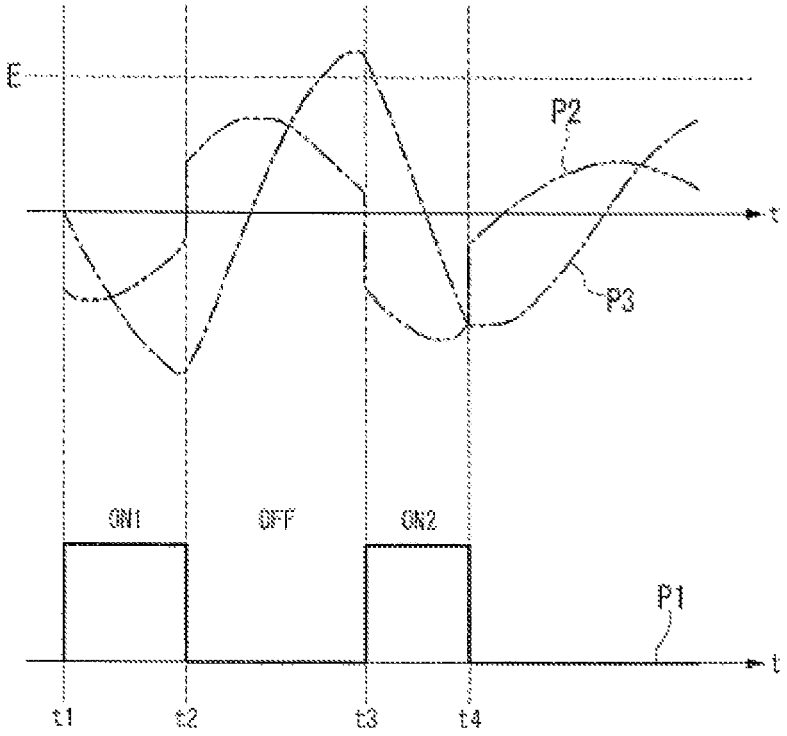
FIG. 6 is an explanatory diagram of the control for reducing the size of a droplet in 1-drop ejection in the first embodiment of the disclosure.

FIG. 6 is an explanatory diagram of the control for reducing the size of the droplet in the 1-drop ejection. In the present diagram, the horizontal axis represents time t. The drive waveform P1 represents the waveform of the drive voltage to be applied between the common electrode and the individual electrode. In the drive waveform P1, the pulse signal taking the high level in the period from the time t1 to the time t2 is a pulse signal for ejecting the droplet, and is also referred to as a main pulse signal in the following description. Further, the pulse signal taking the high level in the period from the time t3 to the time t4 is an auxiliary pulse signal for pulling back a part of the droplet, which has been ejected due to the main pulse signal. In this drawing, "ON1" represents the high period of the main pulse signal, and "ON2" represents the high period of the auxiliary pulse signal. Further, "OFF" represents the period between the main pulse signal and the auxiliary pulse signal (i.e., the period from the time t2 to the time t3).

Here, in the present embodiment (and the second and third embodiments described later), the main pulse signal (the pulse signal having the pulse width of "ON1") described above corresponds to a specific example of a "first pulse signal" in the disclosure. Further, the auxiliary pulse signal (the pulse signal having the pulse width of "ON2") described above corresponds to a specific example of a "second pulse signal" in the disclosure.

Further, the pressure variation waveform P2 represents the pressure variation in the liquid ejection channel 45A. Further, the ink volume variation waveform P3 represents the volume variation of the meniscus of the ink (liquid) in the liquid ejection channel 45A. In the "ON1" period from the time t1 to the time t2, due to the application of the main pulse signal, the capacity of the liquid ejection channel 45A expands to decrease the internal pressure, and the volume of the ink also decreases. It should be noted that "ON1" of the main pulse signal on this occasion is equal to or shorter than the width of 1 AP. Then, when the "OFF" period begins at the time t2, the capacity of the liquid ejection channel 45A starts contracting to be restored to increase the internal pressure. Thus, when the volume of the ink increases to exceed a threshold value E, the ink starts to be ejected. Here, in the "ON2" period from the time t3 to the time t4, due to the application of the auxiliary pulse signal, the capacity of the liquid ejection channel 45A expands once again to decrease the internal pressure. Thus, a part of the droplet having been ejected is pulled back into the liquid ejection channel 45A to decrease the drop volume of 1 drop.

As described above, in the first embodiment, by applying the auxiliary pulse signal after the main pulse signal, there is performed the control of pulling back a part of the droplet having been ejected into the liquid ejection channel 45A. Thus, it is possible to reduce the size of the droplet in the 1-drop ejection to thereby reduce the minimum drop volume without changing the structure of the head. It should be noted that it is also possible to perform the control so as to further reduce the drop volume to be smaller than the normal 1 drop by setting "ON1" of the main pulse signal to be shorter than the width of 1 AP, and then pull back a part of the droplet having been ejected into the liquid ejection channel 45A by adding the auxiliary pulse signal. In the case of setting "ON1" of the main pulse signal to be shorter than the width of 1 AP, it is possible to further reduce the size of the droplet in the 1-drop ejection to thereby reduce the minimum drop volume without changing the structure of the head compared to the case of setting "ON1" to be equal to the width of 1 AP.

Then, the control method of the control circuit 35 for reducing the size of the droplet in the 1-drop ejection will be described in detail with reference to FIG. 7 through FIG. 14. It should be noted that in FIG. 8 through FIG. 10, FIG. 13, and FIG. 14, there are shown the experimental result in the condition of using the liquid jet head of a standard droplet (the droplet size in the 1-drop ejection is standard) with solvent ink, and the experimental result in the condition of using the liquid jet head of a large droplet (the droplet size in the 1-drop ejection is larger than the standard droplet) with water-based ink. Here, in the experiment in the condition of using the liquid jet head of the standard droplet with the solvent ink, there is used the liquid jet head in which the voltage (the crest value) at which the ejection speed is 5 m/s (meters per second) is 24.4 V, and the drop volume is 8.3 pL (picoliter) in the case of setting "ON1" to the width of 1 AP in the drive waveform shown in FIG. 7 described below as a comparative example. In contrast, in the experiment in the condition of using the liquid jet head of the large droplet with the water-based ink, there is used the liquid jet head (IRH2513 series made by SII Printek Inc.) in which the voltage (the crest value) at which the ejection speed is 5 m/s is 22.1 V, and the drop volume is 14.7 pL in the case of setting "ON1" to the width of 1 AP in the drive waveform shown in FIG. 7.

[Comparative Example]

Firstly, as a comparative example, there will be described an example of the control method of not adding the auxiliary pulse signal.

Figures 7, 8:
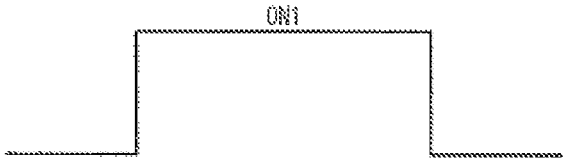
FIG. 7 is a diagram showing an example of a drive waveform related to a comparative example.
FIG. 8 is a table showing a first example of an experimental result when varying the width of "ON1" of a main pulse signal due to the control related to the comparative example.
Figures 9, 10:
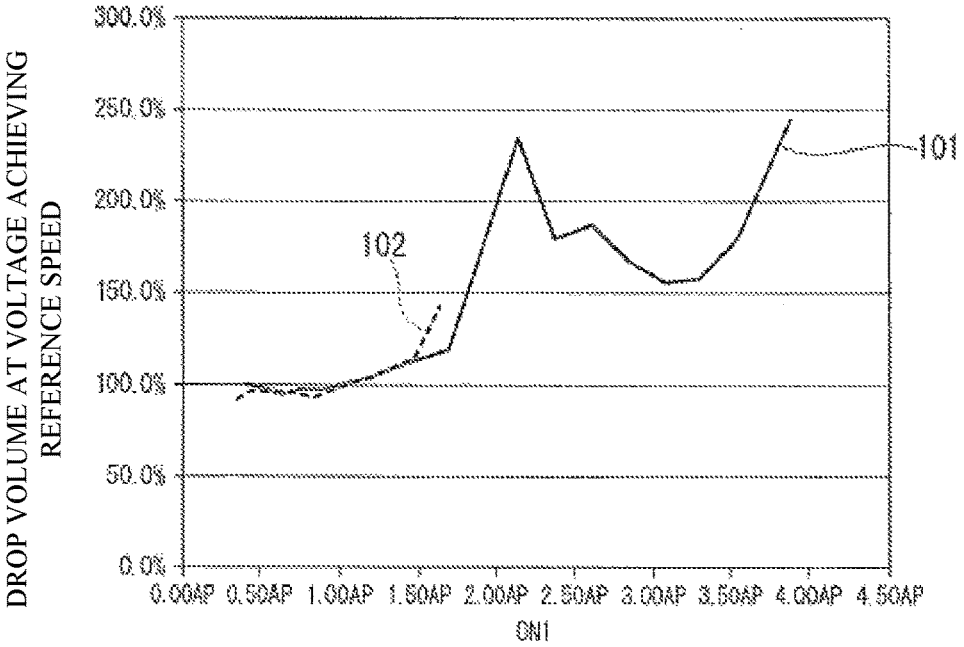
FIG. 9 is a table showing a second example of the experimental result when varying the width of "ON1" of the main pulse signal due to the control related to the comparative example.
FIG. 10 is a diagram obtained by graphing the experimental result in the control related to the comparative example shown in FIG. 8 and FIG. 9.

FIG. 7 is a diagram showing an example of a drive waveform related to the comparative example. In FIG. 7, the horizontal axis represents time. Further, the example shown in FIG. 7 is an example of applying only the main pulse signal in the 1-drop ejection. FIG. 8 and FIG. 9 are each a table showing an experimental result when varying the width of "ON1" of the main pulse signal due to the control related to the comparative example. FIG. 8 shows the experimental result in the condition of using the liquid jet head of the standard droplet with the solvent ink. In contrast, FIG. 9 shows the experimental result in the condition of using the liquid jet head of the large droplet with the water-based ink.

In FIG. 8 and FIG. 9, there is shown a measurement result of the voltage (the crest value) at which the ejection speed is 5 m/s (meters per second) when varying the width of "ON1" of the main pulse signal, and the drop volume at this voltage. Here, the ejection speed of 5 m/s is a target reference speed (e.g., the maximum speed). It should be noted that the voltage (the crest value) achieving 5 m/s and the drop volume shown in the drawings are relative values (ratio in %) defining those in the case, in which "ON1" is equal to the width (1.00 AP) of the on-pulse peak, as 100%.

Further, FIG. 10 is a diagram obtained by graphing the experimental results shown in FIG. 8 and FIG. 9, and shows the variation in the drop volume when varying the width of "ON1." The horizontal axis represents the width of "ON1," and the vertical axis represents the drop volume at the voltage (the crest value) achieving the reference speed. Further, the solid line 101 represents the variation in the drop volume in the condition of the standard droplet, and the dotted line 102 represents the variation in the drop volume in the condition of the large droplet.

As shown in FIG. 8 through FIG. 10, in the control method related to the comparative example not using the auxiliary pulse signal, the drop volume decreases to the minimum when "ON1" is 0.65 AP in the condition of the standard droplet, and "ON1" is 0.37 AP in the condition of the large droplet in the case of varying (reducing) the width of "ON1" of the main pulse signal. However, the minimum drop volume is 95.2% in the condition of the standard droplet, or 92. 5% in the condition of the large droplet, therefore, the decrement of the drop volume is less than 8%. Further, the voltage (the crest value) at which the ejection speed is 5 m/s when the minimum drop volume becomes 92.5% in the condition of the large droplet is 162.0%, which is equal to or larger than 1.6 times of the value in the case in which "ON1" is equal to the width (1.00 AP) of the on-pulse peak. Therefore, taking the power consumption into consideration, it is conceivable that the minimum drop volume in the condition of the large droplet becomes 95.9%, and in this case, the decrement of the drop volume is less than 5%.

In such a manner, in the control method related to the comparative example not using the auxiliary pulse signal, it becomes difficult to reduce the size of the droplet in the 1-drip ejection, and as a result, it become also difficult to make the image quality high-definition.

[Reduction of Droplet Size]

Then, a control method of reducing the size of the droplet in the 1-drop ejection according to the first embodiment will be described.

FIG. 11 is a diagram showing an example of the drive waveform for reducing the size of the droplet related to the first embodiment. In FIG. 11, the horizontal axis represents time. Further, in the example shown in FIG. 11, the auxiliary pulse signal having the width of "ON2" is applied after the main pulse signal having the width of "ON1" with a predetermined time interval (the period "OFF"). In other words, in the present embodiment (and the second and third embodiments described later), the "OFF" period corresponds to a specific example of a "predetermined time interval" in the disclosure.

Figures 13, 14:
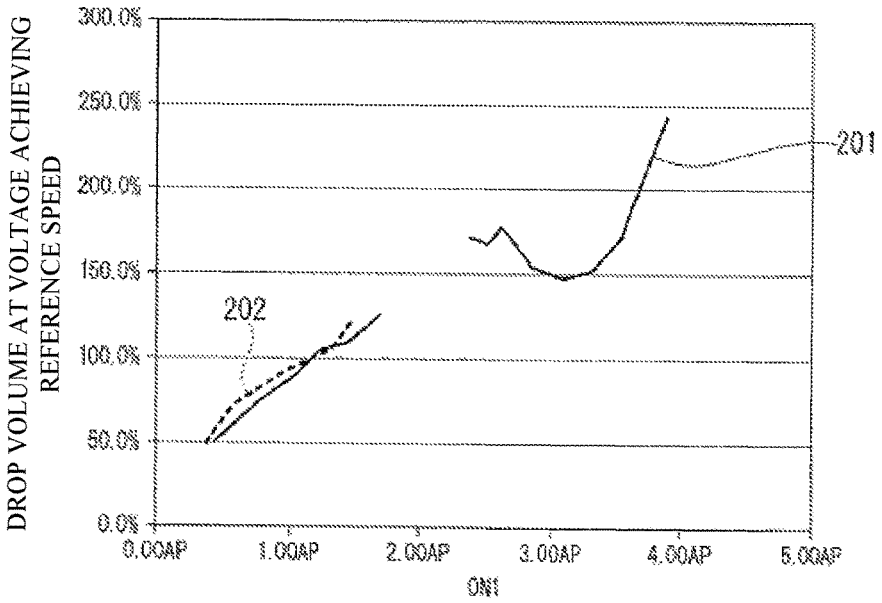
FIG. 13 is a table showing a second example of the experimental result when varying the width of "ON1" of the main pulse signal in the first embodiment of the disclosure.
FIG. 14 is a diagram obtained by graphing the experimental result shown in FIG. 12 and FIG. 13.

FIG. 12 and FIG. 13 are each a table showing an experimental result when varying the width of "ON1" of the main pulse signal in the drive waveform shown in FIG. 11. FIG. 12 shows the experimental result in the condition of using the liquid jet head of the standard droplet with the solvent ink similarly to FIG. 8. In contrast, FIG. 13 shows the experimental result in the condition of using the liquid jet head of the large droplet with the water-based ink similarly to FIG. 9. It should be noted here that "OFF" is fixed to 0.85 AP, and "ON2" is fixed to 0.31 AP. Further, the voltage (the crest value) achieving 5 m/s (the reference speed) and the drop volume shown in the drawings are relative values (ratio in %) defining those in the case, in which "ON1" is equal to the width (1.00 AP) of the on-pulse peak in the control related to the comparative example not adding the auxiliary pulse signal, as 100%.

Further, FIG. 14 is a diagram obtained by graphing the experimental results shown in FIG. 12 and FIG. 13, and shows the variation in the drop volume when varying the width of "ON1." The horizontal axis represents the width of "ON1," and the vertical axis represents the drop volume at the voltage (the crest value) achieving the reference speed. Further, the solid line 201 represents the variation in the drop volume in the condition of the standard droplet, and the dotted line 202 represents the variation in the drop volume in the condition of the large droplet.

As shown in FIG. 12 through FIG. 14, in the control method of adding the auxiliary pulse signal, by shortening "ON1" of the main pulse signal to a value equal to or shorter than (more effectively shorter than the width of the on-pulse peak) the width (1.00 AP) of the on-pulse peak, it is possible to reduce the size of the droplet. For example, in the experimental result shown in the drawings, the drop volume decreases as the width of "ON1" becomes shorter than the width of the on-pulse peak in such a manner that the drop volume is 88.0% when "ON1" is 1.00 AP, 74.7% when "ON1" is 0.77 AP, and 66.3% when "ON1" is 0.65 AP in the condition of the standard droplet. Further, when "ON1" is 0.42 AP, it is possible to reduce the drop volume by roughly half to 49.4%.

Further, in the experimental result shown in the drawings, the drop volume decreases as the width of "ON1" becomes shorter than the width of the on-pulse peak in such a manner that the drop volume is 93.9% when "ON1" is 1.00 AP, 86.4% when "ON1" is 0.84 AP, and 78.9% when "ON1" is 0.68 AP in the condition of the large droplet. Further, when "ON1" is 0.37 AP, it is possible to set the drop volume to 49.0% which corresponds to the maximum reduction of 51%. It should be noted that in the case in which "ON1" is 0.42 AP in the condition of the standard droplet, and the case in which "ON1" is 0.37 AP in the condition of the large droplet, the voltage (the crest value) has risen by roughly 50%, specifically to 148.0% and 158.4%, respectively, and therefore, taking the power consumption into consideration, it is possible to set the range up to 0.54 AP, for example, as an available range. It should be noted that in the case in which "ON1" is 0.29 AP, since the pulse width is too short (i.e., the time for expanding the actuator plate 40 is too short), it has resulted in a liquid ejection failure.

As described hereinabove, the liquid jet head 4 provided to the liquid jet recording device 1 according to the first embodiment is provided with the plurality of nozzle holes 43*a*, the actuator plate 40, and the control circuit 35, wherein the ink (the liquid) is jetted from the plurality of nozzle holes 43*a*, the actuator plate 40 has the plurality of liquid ejection channels 45A individually communicated with the plurality of nozzle holes 43*a*, and filled with the ink, and varies the capacity in each of the liquid ejection channels 45A, and the control circuit 35 applies the pulse signal to the actuator plate 40 to thereby expand or contract the capacity of each of the liquid ejection channels 45A to jet the ink filling the liquid ejection channel 45A. Further, when jetting 1 drop of the ink, the control circuit 35 applies the pulse signal for expanding the capacity in the liquid ejection channel 45A so as to include the main pulse signal (the first pulse signal) having the pulse width (the width of "ON1" shown in FIG. 11) equal to or shorter than the width of the on-pulse peak, and the auxiliary pulse signal (the second pulse signal) disposed with the predetermined time interval ("OFF" shown in FIG. 11) from the main pulse signal. Specifically, in the present embodiment (and the second and third embodiments described later), the control circuit 35 applies the main pulse signal and the auxiliary pulse signal as the pulse signals for expanding the capacity in the liquid ejection channel 45A when jetting 1 drop of the ink.

Thus, it is possible to reduce the size of the droplet in the 1-drop ejection without changing the structure of the liquid jet head 4, and for example, it is possible to reduce the minimum drop volume as much as up to roughly 51% compared to the comparative example described above. Therefore, according to the first embodiment, it is possible to easily reduce the size of the droplet in the 1-drop ejection, and it is possible to make the image quality high-definition.

It should be noted that in the case of setting the width of "ON1" of the main pulse signal to be shorter than the width of the on-pulse peak, the volume of the ink (the liquid) corresponding to 1 drop, which has not yet been pulled back due to the auxiliary pulse signal, decreases, and thus, it is possible to further reduce the size of the droplet in the 1-drop ejection compared to the case of setting the width of "ON1" of the main pulse signal to be equal to the width of the on-pulse peak.

Further, by varying the width of "ON1" of the main pulse signal in a range of equal to or shorter than the width of the on-pulse peak, it is possible to vary the minimum drop volume in the 1-drop ejection.

<2. Second Embodiment>

Then, a second embodiment will be described. The configuration of the liquid jet recording device 1 according to the second embodiment is substantially the same as in the first embodiment, and therefore, the description thereof will be omitted. It should be noted that the method for driving a liquid jet head according to the second embodiment is embodied in the liquid jet recording device 1 according to the second embodiment, and will therefore be described at the same time.

Although in the first embodiment, there is described the case of varying the width of "ON1" while fixing the width of "OFF" and the width of "ON2" in the control method of adding the auxiliary pulse signal, in the second embodiment, there is described the case of varying the width of "OFF" while fixing the width of "ON1" and the width of "ON2." It should be noted that the drive waveform is the waveform shown in FIG. 11, and the liquid jet head used in each of the experiments in the condition of the standard droplet and the condition of the large droplet is substantially the same as in the first embodiment.

Figures 16, 17:
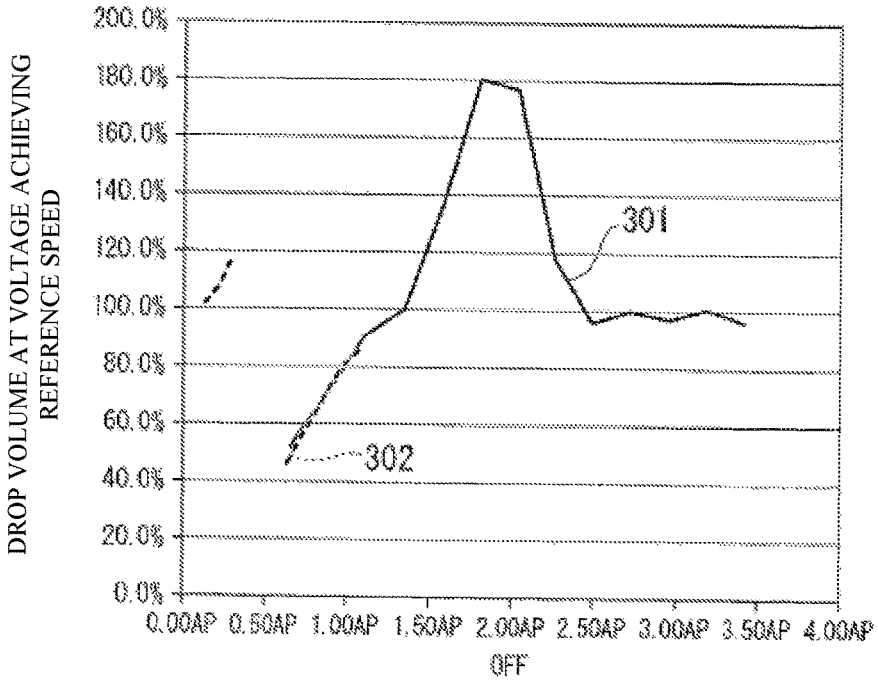
FIG. 16 is a table showing a second example of an experimental result when varying the width of "OFF" in the second embodiment of the disclosure.
FIG. 17 is a diagram obtained by graphing the experimental result shown in FIG. 15 and FIG. 16.

FIG. 15 and FIG. 16 are each a table showing an experimental result when varying the width of "OFF" between the main pulse signal and the auxiliary pulse signal in the drive waveform shown in FIG. 11. FIG. 15 shows the experimental result in the condition of using the liquid jet head of the standard droplet with the solvent ink similarly to FIG. 8. In contrast, FIG. 16 shows the experimental result in the condition of using the liquid jet head of the large droplet with the water-based ink similarly to FIG. 9. The width of "ON1" is fixed to a value equal to or shorter than 1 AP based on the experimental result of the first embodiment. Here, the width of "ON1" is fixed to 0.65 AP in the condition of the standard droplet and 0.53 AP in the condition of the large droplet as the value with which the rise in voltage (crest value) is not too large, and the reduction of the drop volume can be expected. It should be noted that the width of "ON2" is substantially the same as in the first embodiment.

Further, FIG. 17 is a diagram obtained by graphing the experimental results shown in FIG. 15 and FIG. 16, and shows the variation in the drop volume when varying the width of "OFF." The horizontal axis represents the width of "OFF," and the vertical axis represents the drop volume at the voltage (the crest value) achieving the reference speed. Further, the solid line 301 represents the variation in the drop volume in the condition of the standard droplet, and the dotted line 302 represents the variation in the drop volume in the condition of the large droplet.

As shown in FIG. 15 through FIG. 17, by setting the width of "ON1" of the main pulse signal to be equal to or shorter than 1 AP, and the width of "OFF" between the main pulse signal and the auxiliary pulse signal to be equal to or shorter than double the width of "ON1," it is possible to reduce the size of the droplet. For example, in the experimental result shown in the drawings, in the condition of the standard droplet, with respect to "ON1" of 0.65 AP, the drop volume in the case in which "OFF" is 1.12 AP is 90.4%, the drop volume in the case in which "OFF" is 1.00 AP is 81.9%, and the drop volume in the case in which "OFF" is 0.88 AP is 71.1%. It should be noted that according to the experimental result, in the case in which "OFF" is equal to or shorter than 0.77 AP, droplet breakup occurs in the droplet to be ejected in some cases.

Further, in the experimental result shown in the drawings, in the condition of the large droplet, with respect to "ON1" of 0.53 AP, the drop volume in the case in which "OFF" is 0.92 AP is 76.2%, the drop volume in the case in which "OFF" is 0.76 AP is 60.5%, the drop volume in the case in which "OFF" is 0.68 AP is 52.4%, and the drop volume in the case in which "OFF" is 0.61 AP is 46.9%. Further, in the case in which "OFF" is 1.08 AP, the drop volume is 87.1%, and thus, the droplet is reduced by 13% in size. It should be noted that according to the experimental result, in the case in which "OFF" is equal to or shorter than 0.45 AP, the droplet breakup occurs in the droplet to be ejected in some cases.

As described hereinabove, it is preferable for the predetermined time interval ("OFF" shown in FIG. 11) from the main pulse signal (the first pulse signal) to the auxiliary pulse signal (the second pulse signal) to be equal to or shorter than double the width of the on-pulse peak, since the droplet can be reduced in size. It should be noted that the pulse width (the width of "ON1" shown in FIG. 11) of the main pulse signal (the first pulse signal) in this case is equal to or shorter than the width of the on-pulse peak (or shorter than the width of the on-pulse peak) similarly to the first embodiment.

As described above, in the second embodiment, since the condition of "OFF" from the main pulse signal to the auxiliary pulse signal is added to the condition of "ON1" of the main pulse signal in the first embodiment, it is possible to reduce the size of the droplet in the 1-drop ejection without changing the structure of the liquid jet head 4 similarly to the first embodiment, and in addition, the reduction can more stably be achieved.

For example, the longer the width of "OFF" becomes, the more the rising time t3 of "ON2" shown in FIG. 6 is delayed, and the smaller the part to be pulled back into the liquid ejection channel 45A out of the ejected droplet theoretically becomes, and therefore, there arises a tendency that the drop volume increases. Further, according to the experimental result shown in FIG. 15 and FIG. 16, if the width of "OFF" is longer than double the width of the on-pulse peak, the droplet breakup occurs in some cases. Therefore, by setting the width of "OFF" to be equal to or shorter than double the width of the on-pulse peak, for example, the droplet can more stably be reduced in size.

Further, as shown in FIG. 15 and FIG. 16, in the case in which the width of "OFF" is shorter than the width of "ON1," the liquid is not ejected (the liquid ejection failure) or the drop volume increases in some cases. Therefore, it is possible to set the predetermined time interval ("OFF" shown in FIG. 11) from the main pulse signal (the first pulse signal) to the auxiliary pulse signal (the second pulse signal) to be equal to or longer than the pulse width (the width of "ON1" shown in FIG. 11) of the main pulse signal.

<3. Third Embodiment>

Next, a third embodiment will be described. The configuration of the liquid jet recording device 1 according to the third embodiment is substantially the same as in the first embodiment, and therefore, the description thereof will be omitted. It should be noted that the method for driving a liquid jet head according to the third embodiment is embodied in the liquid jet recording device 1 according to the third embodiment, and will therefore be described at the same time.

In the first embodiment, there is described the case of varying the width of "ON1" while fixing the width of "OFF" and the width of "ON2" in the control method of adding the auxiliary pulse signal, and in the second embodiment, there is described the case of varying the width of "OFF" while fixing the width of "ON1" and the width of "ON2." In the third embodiment, there is described the case of varying the width of "ON2" while fixing the width of "ON1" and the width of "OFF." It should be noted that the drive waveform is the waveform shown in FIG. 11, and the liquid jet head used in each of the experiments in the condition of the standard droplet and the condition of the large droplet is substantially the same as in the first and second embodiments.

FIG. 18 and FIG. 19 are each a table showing an experimental result when varying the width of "ON2" of the auxiliary pulse signal in the drive waveform shown in FIG. 11. FIG. 18 shows the experimental result in the condition of using the liquid jet head of the standard droplet with the solvent ink similarly to FIG. 8. In contrast, FIG. 19 shows the experimental result in the condition of using the liquid jet head of the large droplet with the water-based ink similarly to FIG. 9. The width of "ON1" is fixed to 0.65 AP in the condition of the standard droplet and 0.53 AP in the condition of the large droplet as a value equal to or shorter than 1 AP similarly to the second embodiment. Further, the width of "OFF" is fixed to a value equal to or shorter than double the width of "ON1" based on the experimental result of the second embodiment. Here, the width of "OFF" is fixed to 0.88 AP in the condition of the standard droplet and 0.76 AP in the condition of the large droplet as the value with which the rise in voltage (crest value) is not too large, the reduction of the drop volume can be expected, and the droplet breakup or the like does not occur.

Further, FIG. 20 is a diagram obtained by graphing the experimental results shown in FIG. 18 and FIG. 19, and shows the variation in the drop volume when varying the width of "ON2." The horizontal axis represents the width of "ON2," and the vertical axis represents the drop volume at the voltage (the crest value) achieving the reference speed. Further, the solid line 401 represents the variation in the drop volume in the condition of the standard droplet, and the dotted line 402 represents the variation in the drop volume in the condition of the large droplet.

As shown in FIG. 18 through FIG. 20, by setting the width of "ON1" to be equal to or shorter than 1 AP, the width of "OFF" to be equal to or shorter than double the width of "ON1," and the width of "ON2" to be shorter than the width of "ON1," it is possible to reduce the size of the droplet. For example, in the experimental result shown in the drawings, in the condition of the standard droplet, with respect to "ON1" of 0.65 AP, the drop volume in the case in which "ON2" is in a range of 0.58 AP through 0.12 AP is in a range of 79.5% through 68.7%, and thus, the droplet is reduced in size. Further, in the condition of the large droplet, with respect to "ON1" of 0.53 AP, the drop volume in the case in which "ON2" is in a range of 0.45 AP through 0.12 AP is in a range of 57.1% through 70.1%, and thus, the droplet is reduced in size.

As described hereinabove, in the liquid jet head 4 provided to the liquid jet recording device 1 according to the third embodiment, it is preferable for the pulse width (the width of "ON2" shown in FIG. 11) of the auxiliary pulse signal (the second pulse signal) to be shorter than the pulse width (the width of "ON1" shown in FIG. 11) of the main pulse signal (the first pulse signal) since the droplet can be reduced in size. It should be noted that in the third embodiment, the pulse width (the width of "ON1" shown in FIG. 11) of the main pulse signal is equal to or shorter than the width of the on-pulse peak (or shorter than the width of the on-pulse peak) similarly to the first embodiment. Further, the predetermined time interval ("OFF" shown in FIG. 11) from the main pulse signal to the auxiliary pulse signal is equal to or shorter than double the width of the on-pulse peak.

As described above, in the third embodiment, since the condition of "ON2" of the auxiliary pulse signal is added to the condition of "ON1" of the main pulse signal in the first embodiment and the condition of "OFF" from the main pulse signal to the auxiliary pulse signal in the second embodiment, it is possible to reduce the size of the droplet in the 1-drop ejection without changing the structure of the liquid jet head 4 similarly to the first and second embodiments, and in addition, the reduction can more stably be achieved.

For example, when increasing the width of "ON2," the falling time t4 of "ON2" shown in FIG. 6 is delayed, and after the volume of the ink (the liquid) in the liquid ejection channel 45A is shifted to increase, the increment of the ink (the liquid) is added, and it is possible for the ink to be ejected due to the capacity of the liquid ejection channel 45A starting to contract to be restored. Therefore, there arises the tendency that the increase in drop volume or the droplet breakup occurs. Therefore, by setting the width of "ON2" to be equal to or shorter than the width of "ON1," for example, the droplet can more stably be reduced in size. More specifically, in the condition of, for example, the standard droplet, in the case in which "ON2" is equal to or shorter than 0.58 AP, the droplet can stably be reduced in size. Further, in the condition of, for example, the large droplet, in the case in which "ON2" is equal to or shorter than 0.45 AP, the droplet can stably be reduced in size. Further, the voltage (the crest value) achieving the reference speed is in a range of about 110 through 120% in the condition of the standard droplet, and in a range of about 130 through 136% in the condition of the large droplet.

As described above, by setting the width of "ON1" to be equal to or shorter than the width of the on-pulse peak (or shorter than the width of the on-pulse peak), the width of "OFF" to be equal to or shorter than double the width of the on-pulse peak, and the width of "ON2" to be equal to or shorter than the width of "ON1," for example, it is possible to stably realize the reduction in size of the droplet while suppressing the rise in voltage (crest value) as shown in FIG. 18 through FIG. 20.

<4. Fourth Embodiment>

Then, a fourth embodiment will be described. The configuration of the liquid jet recording device 1 according to the fourth embodiment is substantially the same as in the first embodiment, and therefore, the description thereof will be omitted. It should be noted that the method for driving a liquid jet head according to the fourth embodiment is embodied in the liquid jet recording device 1 according to the fourth embodiment, and will therefore be described at the same time.

In the first embodiment, there is described the case of varying the width of "ON1" while fixing the width of "OFF" and the width of "ON2" in the control method of adding the auxiliary pulse signal, and in the second embodiment, there is described the case of varying the width of "OFF" while fixing the width of "ON1" and the width of "ON2." Further, in the third embodiment, there is described the case of varying the width of "ON2" while fixing the width of "ON1" and the width of "OFF."

In each of the first through third embodiments, the main pulse signal (the pulse signal having the pulse width of "ON1") and the auxiliary pulse signal (the pulse signal having the pulse width of "ON2") are each formed of a single (one) pulse signal. In other words, in each of the first through third embodiments, just one pulse signal, namely the main pulse signal to be applied immediately before the auxiliary pulse signal alone, is disposed as the pulse signal to be applied prior to the auxiliary pulse signal.

In contrast, in the fourth embodiment, as described hereinafter in detail, the auxiliary pulse signal (the pulse signal having the pulse width of "ON2") is formed of a single pulse on the one hand, the main pulse signal is formed of a plurality of (two or more) pulse signals on the other hand. In other words, in the fourth embodiment, unlike the first through third embodiments described above, a plurality of pulse signals (the main pulse signals) to be applied prior to the auxiliary pulse signals is provided, and it is arranged that there is performed a drive method of a so-called "multi-pulse method."

Figures 21, 22:
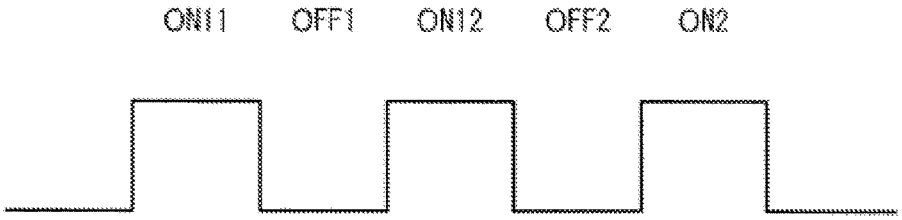
FIG. 21 is a diagram showing an example of a drive waveform in a fourth embodiment of the disclosure.
FIG. 22 is a table showing an example of an experimental result when varying the width of "ON12" in the fourth embodiment of the disclosure.

FIG. 21 is a diagram showing an example of a drive waveform in the fourth embodiment. In the example shown in FIG. 21, as described above, as the main pulse signals to be applied prior to the auxiliary pulse signal (the pulse signal having the pulse width of "ON2"), there are two pulse signals, namely a pulse signal having the pulse width of "ON11," and a pulse signal having the pulse width of "ON12."

Further, in the fourth embodiment, an "OFF1" period as a predetermined time interval is provided between the pulse signal having the pulse width of "ON11" and the pulse signal having the pulse width of "ON12." Similarly, in the fourth embodiment, an "OFF2" period as a predetermined time interval is provided between the pulse signal having the pulse width of "ON12" and the auxiliary pulse signal (the pulse signal having the pulse width of "ON2").

Further, when jetting 1 drop of the ink, the control circuit 35 in the fourth embodiment applies the pulse signal for expanding the capacity in the liquid ejection channel 45A so as to include the main pulse signal having the pulse width (the width of "ON12") equal to or shorter than the width of the on-pulse peak, and the auxiliary pulse signal disposed with the predetermined time interval ("OFF2") from the main pulse signal. Specifically, in the present embodiment, the control circuit 35 applies the two main pulse signals (the two pulse signals respectively having the pulse width of "ON11" and the pulse width of "ON12") described above and the single auxiliary pulse signal as the pulse signals for expanding the capacity in the liquid ejection channel 45A when jetting 1 drop of the ink.

Here, in the present embodiment, unlike the first through third embodiments described hereinabove, the pulse signal having the pulse width of "ON12" out of the two main pulse signals corresponds to a specific example of the "first pulse signal" in the disclosure. In other words, out of the plurality of main pulse signals, only the main pulse signal applied immediately before the auxiliary pulse signal corresponds to a specific example of the "first pulse signal" in the disclosure. Further, in the present embodiment, unlike the first through third embodiments described hereinabove, only the "OFF2" period out of the "OFF1" period and the "OFF2" period described above corresponds to a specific example of the "predetermined time interval" in the disclosure.

Therefore, also in the present embodiment, it is also possible to set each of the pulse width of "ON12," the pulse width of "ON2," the length of the "OFF2" period and so on in a similar manner to those of the first through third embodiments described hereinabove.

FIG. 22 is a table showing the experimental result in the case of varying the width of "ON12" out of the main pulse signals in the drive waveform shown in FIG. 21, and is the experimental result in the condition using the liquid jet head of the large droplet with the water-based ink similarly to FIG. 9. It should be noted that the width of "ON11" is fixed to 0.58 AP, and the width of "ON2" is fixed to 0.31 AP as a value equal to or shorter than 1 AP similarly to the first and second embodiments. Further, the width of "OFF1" and the width of "OFF2" are fixed to 1.42 AP, 0.46 AP, respectively.

It should be noted that the voltage (the crest value) achieving 6 m/s (the reference speed) and the drop volume shown in the drawing are relative values (ratio in %) defining those in the case, in which "ON12" is equal to the width (1.00 AP) of the on-pulse peak in the control of the case of not adding the auxiliary pulse signal (the case of applying the two main pulse signals described above alone), as 100%.

Figure 23:
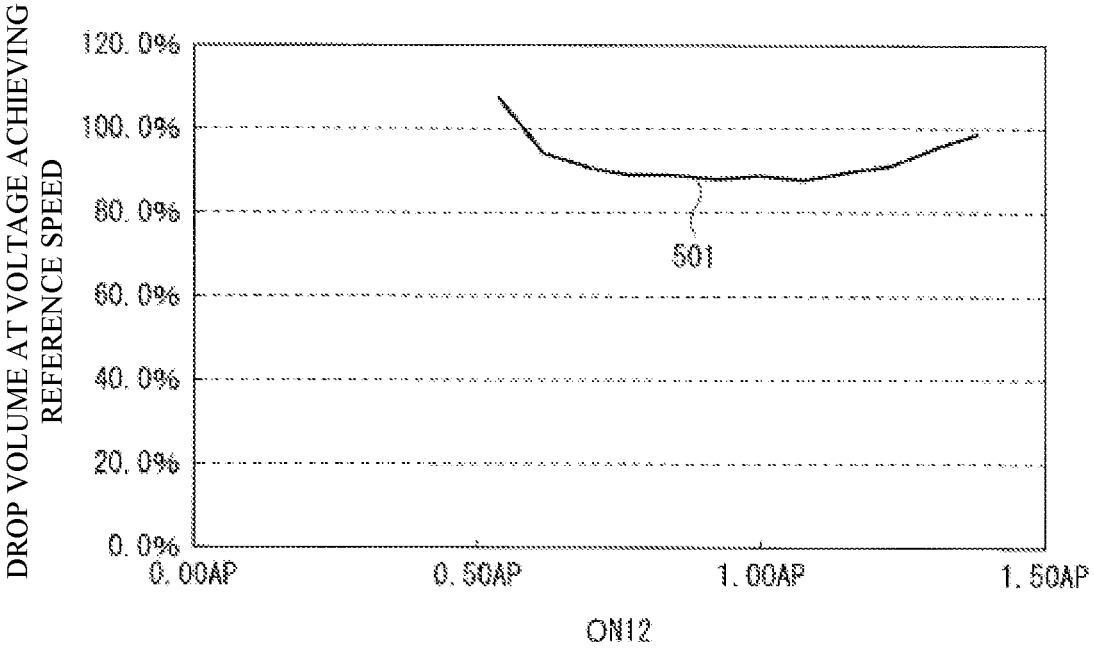
FIG. 23 is a diagram obtained by graphing the experimental result shown in FIG. 22.

Further, FIG. 23 is a diagram obtained by graphing the experimental result shown in FIG. 22, and shows the variation (see the solid line 501) in the drop volume when varying the width of "ON12." The horizontal axis represents the width of "ON12," and the vertical axis represents the drop volume at the voltage (the crest value) achieving the reference speed.

As shown in FIG. 22 and FIG. 23, also in the drive method (the drive method of the "multi-pulse method") according to the present embodiment, it is possible to reduce the size of the droplet similarly to the first through third embodiments described hereinabove. Specifically, in the present experimental result, the drop volume is in the range of 87.6% through 98.7% except some of the conditions, and thus, the droplet is reduced in size. In other words, also in the case of the multi-pulse method, there is shown the phenomenon that by adding the auxiliary pulse signal (the pulse signal having the pulse width of "ON2"), the drop volume in the case of ejecting 1 drop of the ink is reduced (1 drop is reduced in size).

It should be noted that in the present embodiment, as described above, it is arranged that the widths of "ON11," "ON2," "OFF1," "OFF2" are fixed, and at the same time, the width of "ON12" is varied, but this example is not a limitation. Specifically, in the case of the multi-pulse method as in the present embodiment, it is also possible to vary the drop volume while reducing the size of the droplet similarly to the present embodiment by, for example, varying the widths of "ON11," "ON2," and the widths of "OFF1," "OFF2."

In such a manner, in the present embodiment, when jetting 1 drop of the ink, there applies the pulse signal for expanding the capacity in the liquid ejection channel 45A so as to include the main pulse signal having the pulse width (the width of "ON12") equal to or shorter than the width of the on-pulse peak, and the auxiliary pulse signal (the pulse signal having the pulse width of "ON2") disposed with the predetermined time interval ("OFF2") from the main pulse signal.

Thus, it is possible to reduce the size of the droplet in the 1-drop ejection without changing the structure of the head to thereby reduce the minimum drop volume. Therefore, similarly to the first through third embodiments, according also to the fourth embodiment, it is possible to easily reduce the size of the droplet in the 1-drop ejection, and it is possible to make the image quality high-definition.

Further, in particular in the present embodiment, it is arranged that the auxiliary pulse signal is added in the case of the multi-pulse method as described above, the following advantages, for example, can be obtained. That is, in general, in the multi-pulse method, the drop volume in the case of ejecting 1 drop of the ink takes a discrete value in accordance with the number of pulse signals and the pulse width, but it becomes possible to define an ejection value for interpolating between such discrete values by adding the auxiliary pulse signal. Therefore, it is possible to increase the number of ink ejection values which can be set, and it becomes possible to enhance the convenience.

It should be noted that in the present embodiment, the control circuit 35 applies the two main pulse signals described above and the single auxiliary pulse signal as the pulse signals for expanding the capacity in the liquid ejection channel 45A when jetting 1 drop of the ink. In other words, in the present embodiment, in the case of the multi-pulse method, the description is presented citing the case of the so-called "2-drop waveform" as an example. However, this example is not a limitation, and it is also possible to arrange that the auxiliary pulse signal is additionally applied in a similar manner as in the present embodiment with respect also to the case of a "3-or-more-drop waveform." Specifically, it is also possible for the control circuit 35 to apply three or more main pulse signals and the single auxiliary pulse signal as the pulse signals for expanding the capacity in the liquid ejection channel 45A when jetting 1 drop of the ink. It should be noted that also in this case, out of the three or more main pulse signals, only the main pulse signal applied immediately before the auxiliary pulse signal corresponds to a specific example of the "first pulse signal" in the disclosure.

As described hereinabove with respect to the first through fourth embodiments, by using any of the control methods according respectively to the first through fourth embodiments, it is possible to reduce the size of the droplet in the 1-drop ejection without changing the head structure, and thus, it becomes possible to vary the minimum drop volume in the 1-drop ejection. Further, as is understood from the experimental results of the first through fourth embodiments, any of the control methods according respectively to the first through fourth embodiments can be applied regardless of the types (e.g., the solvent ink and the water-based ink) of the ink.

<5. Modified Examples>

The disclosure is described hereinabove citing some embodiments, but the disclosure is not limited to these embodiments, and a variety of modifications can be adopted.

For example, in the embodiments described above, there is described the case in which the head chip 26 is made as a so-called edge-shoot type for ejecting the ink from the nozzle holes 43*a* opening at the end part in the longitudinal direction of the liquid ejection channel 45A. However, the invention is not limited to this configuration, but it is also possible to apply the configuration of the embodiments described above to a so-called side-shooting type head chip for ejecting the ink from nozzle holes opening in the middle in the longitudinal direction of the liquid ejection channels 45A. Further, the liquid jet head 4 can also be a circulating liquid jet head for refluxing the ink supplied to each of the liquid ejection channels 45A to the reservoir chamber of the pressure damper 32, or can also be a non-circulating liquid jet head.

Further, in the embodiments described above, there is explained the liquid jet recording device 1 for moving the pair of conveyers 2, 3 for conveying the recording target medium S such as recording paper and the scanner 6 for performing scanning with the liquid jet heads 4 in the scanning direction X perpendicular to the conveying direction Y of the recording target medium S to perform recording. However, instead thereof, it is also possible to adopt a liquid jet recording device for two-dimensionally moving the recording target medium with the moving mechanism while fixing the scanner 6 to perform recording. In other words, it is sufficient for the moving mechanism to move the liquid jet head and the recording target medium relatively to each other.

Further, in the embodiments described above, there is described the case in which the pulse signal for expanding the capacity of the liquid ejection channel 45A is the pulse signal (a positive pulse signal) for expanding the capacity during the high period, but the case is not a limitation. Specifically, besides the pulse signal for expanding the capacity during the high period and contracting the capacity during the low period, it is also possible to adopt a pulse signal (a negative pulse signal) for expanding the capacity during the low period and contracting the capacity during the high period by contraries.

Further, for example, it is also possible to arrange that a signal for helping the ejection of the droplet is additionally applied immediately after the "ON" period and during the "OFF" period. As the signal for helping the ejection of the droplet, there can be cited, for example, a pulse signal for contracting (further contracting the capacity after once contracting the capacity having been expanded) the capacity in the liquid ejection channel 45A. It should be noted that even if such a signal for helping the ejection of the droplet is added, the content (e.g., the drive method) of the disclosure described hereinabove is not affected.

It should be noted that it is also possible to realize the whole or a part of the function of each of the sections provided to the control circuit 35 in the embodiments described above by recording the program for realizing the functions on a computer-readable recording medium, and then making the computer system retrieve and then execute the program recorded on the recording medium. It should be noted that the "computer system" mentioned here should include an OS and the hardware such as peripheral devices. Further, such a "program" corresponds to a specific example of a "program for driving a liquid jet head" in the disclosure.

Further, the "computer-readable recording medium" denotes a portable recording medium such as a flexible disk, a magneto-optical disk, a ROM, and a CD-ROM, and a storage section such as a hard disk incorporated in the computer system. Further, the "computer-readable recording medium" can include those dynamically holding a program for a short period of time such as a communication line in the case of transmitting the program via a network such as the Internet or a communication line such as a telephone line, and those holding a program for a certain period of time such as a volatile memory in a computer system functioning as a server or a client in that occasion. Further, the program described above can be those for partially realizing the functions described above, or those capable of realizing the functions described above in combination with a program having already been recorded on the computer system.

Further, the control circuit 35 in the embodiments described above can also be realized as an integrated circuit such as an LSI (Large Scale Integration). Further, for example, the control circuit 35 can also be integrated as a processor. Further, the method of the circuit integration is not limited to LSI, but the circuit can be realized by a dedicated circuit or a general-purpose processor. Further, in the case in which a technology of the circuit integration replacing the LSI appears due to the advance in semiconductor technology, it is also possible to use an integrated circuit derived from such a technology.

Further, it is also possible to apply the variety of examples described hereinabove in arbitrary combination.

It should be noted that the advantages described in the specification are illustrative only but are not a limitation, and another advantage can also be provided.

Further, the disclosure can also take the following configurations.

<1>

A liquid jet head comprising:

a nozzle adapted to jet a liquid;

a piezoelectric actuator having a pressure chamber communicated with the nozzle and filled with the liquid, and adapted to vary a capacity of the pressure chamber; and a control section adapted to apply a pulse signal to the piezoelectric actuator to thereby expand and contract the capacity of the pressure chamber so as to jet the liquid filling the pressure chamber, wherein the control section applies the pulse signal adapted to expand the capacity in the pressure chamber when jetting 1 drop of the liquid so as to include a first pulse signal having a pulse width one of equal to or shorter than an on-pulse peak, and a second pulse signal disposed with a predetermined time interval from the first pulse signal.

<2>

The liquid jet head according to <1>, wherein the first pulse signal is the pulse signal to be applied immediately before the second pulse signal, and a pulse width of the second pulse signal is shorter than the pulse width of the first pulse signal.

<3>

The liquid jet head according to <2>, wherein the predetermined time interval is one of equal to or shorter than double the width of the on-pulse peak.

<4>

The liquid jet head according to any one of <1>to <3>, wherein the first pulse signal is the pulse signal to be applied immediately before the second pulse signal, and the predetermined time interval is one of equal to or longer than the pulse width of the first pulse signal.

<5>

The liquid jet head according to any one of <1>to <4>, wherein the first pulse signal is the pulse signal to be applied immediately before the second pulse signal, and the pulse width of the first pulse signal is shorter than the width of the on-pulse peak.

<6>

The liquid jet head according to any one of <1>to <5>, wherein the pulse width of the second pulse signal is one of equal to or shorter than 0.58 times the width of the on-pulse peak.

<7>

The liquid jet head according to any one of <1>to <6>, wherein the control section provides a plurality of the pulse signals to be applied prior to the second pulse signal when jetting 1 drop of the liquid, the plurality of the pulse signals including the first pulse signal to be applied immediately before the second pulse signal.

<8>

A liquid jet recording device comprising:

the liquid jet head according to any one of claims 1 through 7.

<9>

A method for driving a liquid jet head, comprising:

applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet 1 drop of liquid filling the pressure chamber from the nozzle, wherein applying the pulse signal includes applying a first pulse signal having a pulse width one of equal to or shorter than a width of an on-pulse peak, and applying a second pulse signal disposed with a predetermined time interval from the first pulse signal.

<10>

A program for driving a liquid jet head and adapted to make a computer perform a process comprising:

applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet a drop of liquid filling the pressure chamber from the nozzle, wherein applying the pulse signal includes applying a first pulse signal having a pulse width one of equal to or shorter than a width of an on-pulse peak, and applying a second pulse signal disposed with a predetermined time interval from the first pulse signal.

What is claimed is:

1. A liquid jet head comprising:

a nozzle adapted to jet a liquid;

a piezoelectric actuator having a pressure chamber communicated with the nozzle and filled with the liquid, and adapted to vary a capacity of the pressure chamber; and a control section adapted to apply a pulse signal to the piezoelectric actuator to thereby expand and contract the capacity of the pressure chamber so as to jet the liquid filling the pressure chamber, wherein the control section applies the pulse signal adapted to expand the capacity in the pressure chamber when jetting 1 drop of the liquid so as to include a first pulse signal having a pulse width shorter than an on-pulse peak, and a second pulse signal disposed with a predetermined time interval from the first pulse signal, wherein the predetermined time interval is 0.61 to 1.08 times the width of the on-pulse peak.

2. The liquid jet head according to claim 1, wherein the first pulse signal is the pulse signal to be applied immediately before the second pulse signal, and a pulse width of the second pulse signal is shorter than the pulse width of the first pulse signal.

3. The liquid jet head according to claim 1, wherein the first pulse signal is the pulse signal to be applied immediately before the second pulse signal, and the predetermined time interval is one of equal to or longer than the pulse width of the first pulse signal.

4. The liquid jet head according to claim 1, wherein the pulse width of the second pulse signal is one of equal to or shorter than 0.58 times the width of the on-pulse peak.

5. The liquid jet head according to claim 1, wherein the control section provides a plurality of the pulse signals to be applied prior to the second pulse signal when jetting 1 drop of the liquid, the plurality of the pulse signals including the first pulse signal to be applied immediately before the second pulse signal.

6. A liquid jet recording device comprising:

The liquid jet head according to claim 1.

7. A method for driving a liquid jet head, comprising:

applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet 1 drop of liquid filling the pressure chamber from the nozzle, wherein applying the pulse signal includes applying a first pulse signal having a pulse width shorter than a width of an on-pulse peak, and applying a second pulse signal disposed with a predetermined time interval from the first pulse signal, wherein the predetermined time interval is 0.61 to 1.08 times the width of the on-pulse peak.

8. A non-transitory computer-readable medium having stored thereon a program for driving a liquid jet head that, when executed by a computer, cause the computer to perform a process comprising:

applying a pulse signal adapted to expand a capacity of a pressure chamber when applying the pulse signal to a piezoelectric actuator adapted to vary the capacity of the pressure chamber communicated with a nozzle to thereby expand and contract the capacity of the pressure chamber so as to jet a drop of liquid filling the pressure chamber from the nozzle, wherein applying the pulse signal includes applying a first pulse signal having a pulse width shorter than a width of an on-pulse peak, and applying a second pulse signal disposed with a predetermined time interval from the first pulse signal, wherein the predetermined time interval is 0.61 to 1.08 times the width of the on-pulse peak.

* * * * *